US007019712B2

(12) United States Patent
Kanzaki

(10) Patent No.: US 7,019,712 B2
(45) Date of Patent: Mar. 28, 2006

(54) ANTENNA CONTROL SYSTEM AND CONTROL METHOD

(75) Inventor: Akihiro Kanzaki, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 537 days.

(21) Appl. No.: 10/362,449

(22) PCT Filed: Feb. 27, 2002

(86) PCT No.: PCT/JP02/01806

§ 371 (c)(1),
(2), (4) Date: Feb. 25, 2003

(87) PCT Pub. No.: WO02/071537

PCT Pub. Date: Sep. 12, 2002

(65) Prior Publication Data

US 2003/0179145 A1 Sep. 25, 2003

(30) Foreign Application Priority Data

Mar. 2, 2001 (JP) ..... 2001-58744

(51) Int. Cl.
*H01Q 15/20* (2006.01)

(52) U.S. Cl. ..... 343/915

(58) Field of Classification Search ..... 343/DIG. 2, 343/915; 342/352
See application file for complete search history.

(56) References Cited

U.S. PATENT DOCUMENTS 4,343,005 A * 8/1982 Han et al. ..... 343/781 P
4,726,224 A * 2/1988 D'Ausilio ..... 73/167
5,621,415 A * 4/1997 Tuck ..... 342/354
6,101,178 A * 8/2000 Beal ..... 370/336

FOREIGN PATENT DOCUMENTS

| | | | |
|---|---|---|---|
| JP | 9-247070 | A | 9/1997 |
| JP | 2000-183645 | A | 6/2000 |
| JP | 2000-286620 | A | 10/2000 |
| JP | 2001-60817 | A | 6/2001 |
| WO | 99/36989 | A1 | 7/1999 |
| WO | WO 00/45463 | | 8/2000 |

OTHER PUBLICATIONS

Supplementary European Search Report dated Nov. 12, 2004.

* cited by examiner

*Primary Examiner*—James Clinger
*Assistant Examiner*—Minh Dieu A
(74) *Attorney, Agent, or Firm*—Nixon & Vanderhye, P.C.

(57) ABSTRACT

The elevation angle and azimuth angle and the required angles of rotation for the first antenna 33 and the second antenna 34 are calculated using predetermined calculating means. The elevation adjustment mechanism and azimuth adjustment mechanism and rotating mechanisms of the first antenna 33 and the second antenna 34 are controlled so that the first antenna 33 and the second antenna 34 will be pointed toward respective communication targets T1 and T2 (the first satellite and the second satellite).

8 Claims, 16 Drawing Sheets

ANTENNA CONTROL SYSTEM AND CONTROL METHOD

This application is a continuation of international application PCT/JP02/01806 filed 27 Feb. 2002 which designates the U.S.

1. Technical Field

The present invention relates to an antenna control system and control method for establishing communication with, stationary targets such as stationary satellites of which the positional information is known and/or, moving targets such as non-stationary satellites of which the movement information is known.

2. Background Art

Conventionally, various antenna control systems and control methods for establishing communication with, stationary targets such as stationary satellites of which the positional information is known and/or, moving targets such as non-stationary satellites of which the movement information is known, are available.

A conventional antenna device is comprised of, for example, an elevation adjustment mechanism 243 and an azimuth adjustment mechanism 244, as shown in FIG. 22. Using the elevation adjustment mechanism 243 and azimuth adjustment mechanism 244 the elevation and azimuth of antenna 241 are adjusted so that the antenna 241 can be pointed towards an arbitrary direction with respect to a pedestal 242.

That is, in the conventional antenna device, a total of two axes are used to point the antenna 241 at a communication target. So, when telecommunication needs to be established concurrently with a plurality of communication targets, generally as many antenna devices as the number of the communication targets have to be used.

Setting a multiple number of antenna devices not only needs a large space for installation but also suffers from the problem that some antennae may disturb the communications of others, depending on the relationship between the positions of the antennae and the direction of the communication targets.

More specifically, as shown in FIG. 23, in an antenna system having a multiple number of antennae 12*a, b* mounted on a rotary table 11 capable of rotating about an axis, when two antennae 12 are caused to acquire a communication target 21 at the same time, the front antenna 12*b* may obstruct the rear antenna 12*a* as shown in FIG. 24 and the transmission and/or reception level of the rear antenna may be degraded.

As a method for solving this problem, Japanese Patent Application Laid-open Hei 9 No.247070 discloses a technology in which rotary table 11 is turned so that the front antenna will not obstruct the rear antenna.

The technique disclosed in Japanese Patent Application Laid-open Hei 9 No.247070, however, needs complicated control because the axis for turning the rotary table 11 should be added and further has drawbacks such as enlargement of the antenna system, increase in price, increase in weight, increase in time and labor for transportation and installation.

In order to solve the above problem, an antenna device shown in FIG. 1 can be considered.

Specifically, the antenna device shown in FIG. 1 is comprised of first and second arms 31 and 32, which are arranged in parallel and in a non-opposing manner on the same plane, respectively having axes C1 and C2 along the same direction, a first antenna 33 which is supported by first arm 31 so that the attitude can be directed arbitrarily with respect to the axis C1, a second antenna 34 which is supported by second arm 32 so that the attitude can be directed arbitrarily with respect to the axis C2, a first rotating mechanism 35 for rotating first antenna 33 about axis C1, a second rotating mechanism 36 for rotating second antenna 34 about axis C2, an arm elevation adjustment mechanism 37 for common adjustment of first arm 31 and second arm 32 and an arm azimuth adjustment mechanism 38 for common adjustment of first arm 31 and second arm 32.

This antenna device is characterized that the number of concurrent communication targets is limited to two or below and the two antennae share two common axes so that the number of axes can be reduced compared to the configuration where antennae are placed on the base table.

Nevertheless, since the antenna device shown in FIG. 1 is configured so that the two antennae share two axes, there is a problem that the direction control method for conventional antenna cannot be applied as is.

The present invention has been proposed under the above circumstances, it is therefor an object of the present invention to provide an antenna control system and control method for use in an antenna device that implements concurrent communication with a multiple number of communication targets, the system being able to be reduced in manufacturing cost with easy transportation and installation without increase in system size and weight.

DISCLOSURE OF INVENTION

The antenna control system and control method according to the present invention have the following features in order to attain the above object.

To begin with, the first aspect of the present invention resides in an antenna control system for use in a communication system made up of combination of an antenna device and communication targets, the antenna device of which the positional information being known, comprising:

first and second arms, which are arranged in parallel and in a non-opposing manner on the same plane, respectively having axes C1 and C2 along the same direction;

a first antenna which is supported by the first arm so that the attitude can be directed arbitrarily with respect to the axis C1;

a second antenna which is supported by the second arm so that the attitude can be directed arbitrarily with respect to the axis C2;

a first rotating mechanism for rotating the first antenna about the axis C1;

a second rotating mechanism for rotating the second antenna about the axis C2;

an arm elevation adjustment mechanism for common adjustment of the first arm and second arm; and an arm azimuth adjustment mechanism for common adjustment of the first arm and second arm, the communication targets including two communication targets T1 and T2 of which the positional information or movement information is known, the antenna control system comprising:

a first rotational angle detecting means for detecting the rotational angle of the first rotating mechanism;

a first rotating mechanism control means for controlling the first rotating mechanism;

a second rotational angle detecting means for detecting the rotational angle of the second rotating mechanism;

a second rotating mechanism control means for controlling the second rotating mechanism;

an elevation detecting means for detecting the elevation angle of the arm elevation adjustment mechanism;

an arm elevation adjustment mechanism control means for controlling the arm elevation adjustment mechanism;

an azimuth detecting means for detecting the azimuth angle of the arm azimuth adjustment mechanism;

an arm azimuth adjustment mechanism control means for controlling the arm azimuth adjustment mechanism;

a means D for calculating the plane P containing a triangle defined by the two communication targets T1 and T2 and the installed position of the antenna device, based on the installed position of the antenna device, represented by the latitude, longitude and height and the positional information of the two communication targets T1 and T2;

a means E1 for calculating the elevation angle $\phi$ of the first and second arms when they orthogonally intersect the plane P, based on the calculation result from the means D;

a means E2 for calculating the azimuth angle $\theta$ of the first and second arms when they orthogonally intersect the plane P, based on the calculation result from the means D;

a means F1 for calculating the required angle of rotation RB of axis B that is orthogonal to the axes C1 and C2 so that the elevation angle of the first and second arms will be set at $\phi$, based on the current elevation of the first and second arms, detected by the elevation detecting means and the calculation result from the means E1;

a means F2 for calculating the required angle of rotation RA of axis A that is orthogonal to the axis B as well as to the axes C1 and C2 so that the azimuth angle of the first and second arms will be set at $\theta$, based on the current azimuth of the first and second arms, detected by the azimuth detecting means and the calculation result from the means E2;

a means F3 for calculating the required angle of rotation RC1 of the axis C1 so that the first antenna is pointed at the communication target T1 when the elevation angle and azimuth angle of the first and second arms are set at $\phi$ and at $\theta$; and a means F4 for calculating the required angle of rotation RC2 of the axis C2 so that the second antenna is pointed at the communication target T2 when the elevation angle and azimuth angle of the first and second arms are set at $\phi$ and at $\theta$, characterized in that, based on the calculation results from the means F1, F2, F3 and F4, the elevation adjustment mechanism, the azimuth adjustment mechanism, the first rotating mechanism and the second rotating mechanism are controlled so that the first antenna and the second antenna can be pointed towards the communication targets T1 and T2, respectively.

Next, the second aspect of the present invention resides in the antenna control system having the above first feature, characterized in that the antenna device further comprises: a first received signal level measuring means for measuring the received signal level at the first antenna; and a second received signal level measuring means for measuring the received signal level at the second antenna and that the timing of start of tracking is determined based on the received signal levels measured by the first received signal level measuring means and the second received signal level measuring means.

The third aspect of the present invention resides in an antenna control method for controlling the antenna control system for use in a communication system made up of combination of an antenna device and communication targets, the antenna device of which the positional information being known, comprising:

first and second arms, which are arranged in parallel and in a non-opposing manner on the same plane, respectively having axes C1 and C2 along the same direction;

a first antenna which is supported by the first arm so that the attitude can be directed arbitrarily with respect to the axis C1;

a second antenna which is supported by the second arm so that the attitude can be directed arbitrarily with respect to the axis C2;

a first rotating mechanism for rotating the first antenna about the axis C1;

a second rotating mechanism for rotating the second antenna about the axis C2;

an arm elevation adjustment mechanism for common adjustment of the first arm and second arm; and an arm azimuth adjustment mechanism for common adjustment of the first arm and second arm, the communication targets including two communication targets T1 and T2 of which the positional information or movement information is known, the antenna control system comprising:

a first rotational angle detecting means for detecting the rotational angle of the first rotating mechanism;

a first rotating mechanism control means for controlling the first rotating mechanism;

a second rotational angle detecting means for detecting the rotational angle of the second rotating mechanism;

a second rotating mechanism control means for controlling the second rotating mechanism;

an elevation detecting means for detecting the elevation angle of the arm elevation adjustment mechanism;

an arm elevation adjustment mechanism control means for controlling the arm elevation adjustment mechanism;

an azimuth detecting means for detecting the azimuth angle of the arm azimuth adjustment mechanism;

an arm azimuth adjustment mechanism control means for controlling the arm azimuth adjustment mechanism;

a means D for calculating the plane P containing a triangle defined by the two communication targets T1 and T2 and the installed position of the antenna device, based on the installed position of the antenna device, represented by the latitude, longitude and height and the positional information of the two communication targets T1 and T2;

a means E1 for calculating the elevation angle $\phi$ of the first and second arms when they orthogonally intersect the plane P, based on the calculation result from the means D;

a means E2 for calculating the azimuth angle $\theta$ of the first and second arms when they orthogonally intersect the plane P, based on the calculation result from the means D;

a means F1 for calculating the required angle of rotation RB of axis B that is orthogonal to the axes C1 and C2 so that the elevation angle of the first and second arms will be set at $\phi$, based on the current elevation of the first and second arms, detected by the elevation detecting means and the calculation result from the means E1;

a means F2 for calculating the required angle of rotation RA of axis A that is orthogonal to the axis B as well as to the axes C1 and C2 so that the azimuth angle of the first and second arms will be set at $\theta$, based on the current azimuth of the first and second arms, detected by the azimuth detecting means and the calculation result from the means E2;

a means F3 for calculating the required angle of rotation RC1 of the axis C1 so that the first antenna is pointed at the communication target T1 when the elevation angle and azimuth angle of the first and second arms are set at $\phi$ and at $\theta$; and a means F4 for calculating the required angle of rotation RC2 of the axis C2 so that the second antenna is pointed at the communication target T2 when the elevation angle and azimuth angle of the first and second arms are set at $\phi$ and at $\theta$, the antenna control method comprising:

a step of calculating the plane P1 containing a triangle defined by the two communication targets T1 and T2 and the installed position of the antenna device, using the means D;

a step of calculating the elevation angle $\phi 1$ and azimuth angle $\theta 1$ of the first and second arms when they orthogonally intersect the plane P1 based on the calculation result from the means D, using the means E1 and E2;

a step of actuating the elevation adjustment mechanism and azimuth adjustment mechanism so that the direction of the first and second arms represented by the elevation angle $\phi 1$ and the azimuth angle $\theta 1$ will orthogonally intersect the plane P1, based on the calculation results from the means E1 and E2; and a step of actuating the first rotating mechanism and the second rotating mechanism so that the first antenna and the second antenna will be pointed toward respective communication targets T1 and T2, based on the calculation results from the means E3 and E4, whereby the first arm and the second arm and each of the antennae are moved to point the antennae toward the communication targets T1 and T2.

Next, the fourth aspect of the present invention resides in the antenna control method having the above third feature, wherein the antenna includes: a first received signal level measuring means for measuring the received signal level at the first antenna; and a second received signal level measuring means for measuring the received signal level at the second antenna, the method further comprising a step of maintaining the received signal level by starting a tracking operation when the received signal level measured by either the first received signal level measuring means or the second received signal level measuring means becomes lower than the predetermined reference value for actuating a tracking operation.

The fifth aspect of the present invention resides in the antenna control method having the above third feature, wherein the antenna includes: a first received signal level measuring means for measuring the received signal level at the first antenna; and a second received signal level measuring means for measuring the received signal level at the second antenna, the method further comprising a step of maintaining the received signal level by starting a tracking operation of one of the communication targets by both the first antenna and the second antenna when the received signal level measured by either the first received signal level measuring means or the second received signal level measuring means becomes lower than the predetermined reference value for actuating a tracking operation whereby both the first antenna and the second antenna track one communication target.

Next, the sixth aspect of the present invention resides in the antenna control method having the above fifth feature, wherein in the case where the tracking operation of both the first antenna and the second antenna have started to track one of the communication targets, when the received signal levels measured by both the first received signal level measuring means and the second received signal level measuring means have exceeded the predetermined reference value for restarting the normal tracking operation, for a period longer than a fixed period of time, tracking of the other communication target which has been abandoned is restarted.

The seventh aspect of the present invention resides in the antenna control method having the above third feature, wherein, when the number of communication targets is one, the first antenna and the second antenna are caused to acquire the single communication target at the same time so as to increase the transmitted signal level and received signal level compared to the case where the target is tracked by either the first antenna or the second antenna alone.

Further, the eighth aspect of the present invention resides in an antenna control method for controlling the antenna control system for use in a communication system made up of combination of an antenna device and communication targets, the antenna device of which the positional information being known, comprising:

first and second arms, which are arranged in parallel and in a non-opposing manner on the same plane, respectively having axes C1 and C2 along the same direction;

a first antenna which is supported by the first arm so that the attitude can be directed arbitrarily with respect to the axis C1;

a second antenna which is supported by the second arm so that the attitude can be directed arbitrarily with respect to the axis C2;

a first rotating mechanism for rotating the first antenna about axis C1;

a second rotating mechanism for rotating the second antenna about axis C2;

an arm elevation adjustment mechanism for common adjustment of the first arm and second arm; and an arm azimuth adjustment mechanism for common adjustment of the first arm and second arm, the communication targets including two communication targets T1 and T2 of which the positional information or movement information is known, the antenna control system comprising:

a first rotational angle detecting means for detecting the rotational angle of the first rotating mechanism;

a first rotating mechanism control means for controlling the first rotating mechanism;

a second rotational angle detecting means for detecting the rotational angle of the second rotating mechanism;

a second rotating mechanism control means for controlling the second rotating mechanism;

an elevation detecting means for detecting the elevation angle of the arm elevation adjustment mechanism;

an arm elevation adjustment mechanism control means for controlling the arm elevation adjustment mechanism;

an azimuth detecting means for detecting the azimuth angle of the arm azimuth adjustment mechanism;

an arm azimuth adjustment mechanism control means for controlling the arm azimuth adjustment mechanism;

a means D for calculating the plane P containing a triangle defined by two communication targets T1 and T2 and the installed position of the antenna device, based on the installed position of the antenna device, represented by the latitude, longitude and height and the positional information of the two communication targets T1 and T2;

a means E1 for calculating the elevation angle $\phi$ of the first and second arms when they orthogonally intersect the plane P, based on the calculation result from the means D;

a means E2 for calculating the azimuth angle $\theta$ of the first and second arms when they orthogonally intersect the plane P, based on the calculation result from the means D;

a means F1 for calculating the required angle of rotation RB of axis B that is orthogonal to the axes C1 and C2 so that the elevation angle of the first and second arms will be set at $\phi$, based on the current elevation of the first and second arms, detected by the elevation detecting means and the calculation result from the means E1;

a means F2 for calculating the required angle of rotation RA of axis A that is orthogonal to the axis B as well as to the axes C1 and C2 so that the azimuth angle of the first and second arms will be set at θ, based on the current azimuth of the first and second arms, detected by the azimuth detecting means and the calculation result from the means E2;

a means F3 for calculating the required angle of rotation RC1 of the axis C1 so that the first antenna is pointed at the communication target T1 when the elevation angle and azimuth angle of the first and second arms are set at ϕ and at θ; and a means F4 for calculating the required angle of rotation RC2 of the axis C2 so that the second antenna is pointed at the communication target T2 when the elevation angle and azimuth angle of the first and second arms are set at ϕ and at θ, the antenna control method comprising: a system whereby one of the communication targets to be communicated with is switched from the communication target T2 to a communication target T3 which is located in a direction different from the communication target T2, a step of calculating the plane P2 containing a triangle defined by the communication targets T1 and T3 and the installed position of the antenna device, using the means D;

a step of calculating the elevation angle ϕ2 and azimuth angle θ2 of the first and second arms when they orthogonally intersect the plane P2 based on the calculation result from the means D, using the means E1 and E2; and a step of rotating the first antenna when the arm elevation adjustment mechanism and the arm azimuth adjustment mechanism are actuated, in a manner that the direction of the first antenna being pointed at the first communication target T1 remains as is, canceling the influence on the direction of the antenna due to change of the elevation and azimuth of the arm, whereby the communication target can be switched from the communication target T2 to the communication target T3 while communication with the communication target T1 is maintained.

BEST MODE FOR CARRYING OUT THE INVENTION

Figure 1:
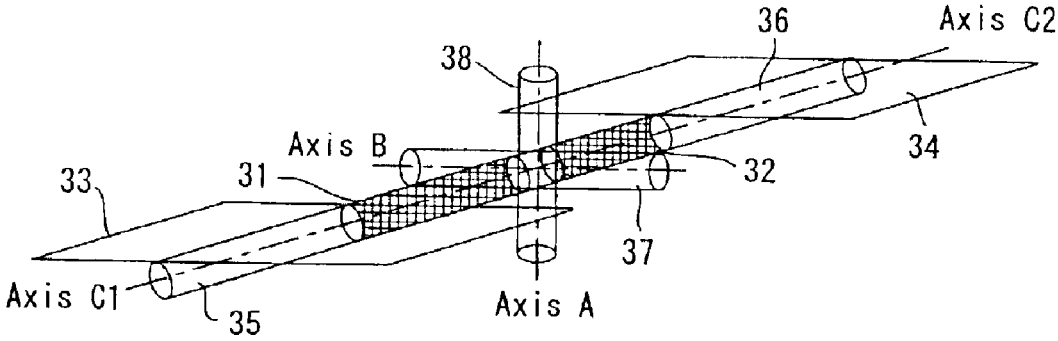
FIG. 1 is a structural principle view showing the basic configuration of an antenna control system according to the present invention.

Next, the embodiments of antenna control systems and control methods according to the present invention will be described based on the specific examples shown in the drawings.

<Embodiment 1>

First, an antenna control system of embodiment 1 will be described.

Figure 2:
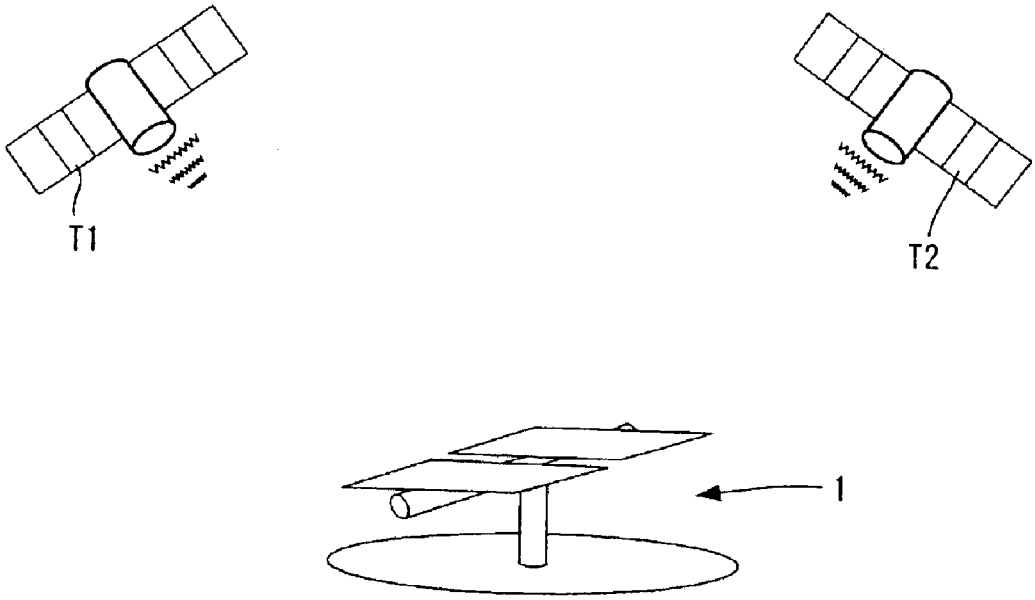
FIG. 2 is a schematic view showing the configuration of a communications system using the antenna control system according to embodiment 1 of the present invention.

The communication system to which an antenna control system of embodiment 1 is applied includes a first satellite T1 and a second satellite T2 and an antenna device 1 for establishing communication with these satellites T1 and T2, as shown in FIG. 2.

This antenna device 1 is comprised of first and second arms 31 and 32, which are arranged in parallel and in a non-opposing manner on the same plane, respectively having axes C1 and C2 along the same direction, a first antenna 33 which is supported by first arm 31 so that the attitude can be directed arbitrarily with respect to the axis C1, a second antenna 34 which is supported by second arm 32 so that the attitude can be directed arbitrarily with respect to the axis C2, a first rotating mechanism 35 for rotating first antenna 33 about axis C1, a second rotating mechanism 36 for rotating second antenna 34 about axis C2, an arm elevation adjustment mechanism 37 for common adjustment of first arm 31 and second arm 32 and an arm azimuth adjustment mechanism 38 for common adjustment of first arm 31 and second arm 32.

Figure 3:
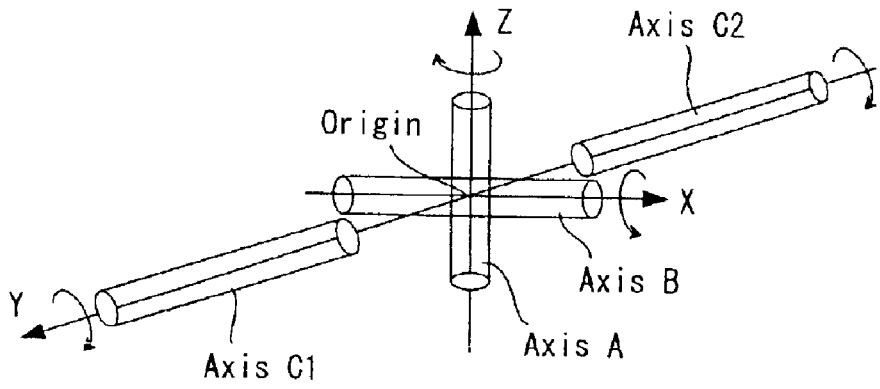
FIG. 3 is an illustrative view showing a coordinate system used in the antenna control system according to embodiment 1 of the present invention.

In this embodiment 1, as shown in FIG. 3, a 3-dimentional rectangular coordinate system having x, y and z axes with an origin at the point of intersection between the four axes A, B, C1 and C2 is used so as to represent a state where satellites T1 and T2 are acquired by first antenna 33 and second antenna 34.

Figure 4:
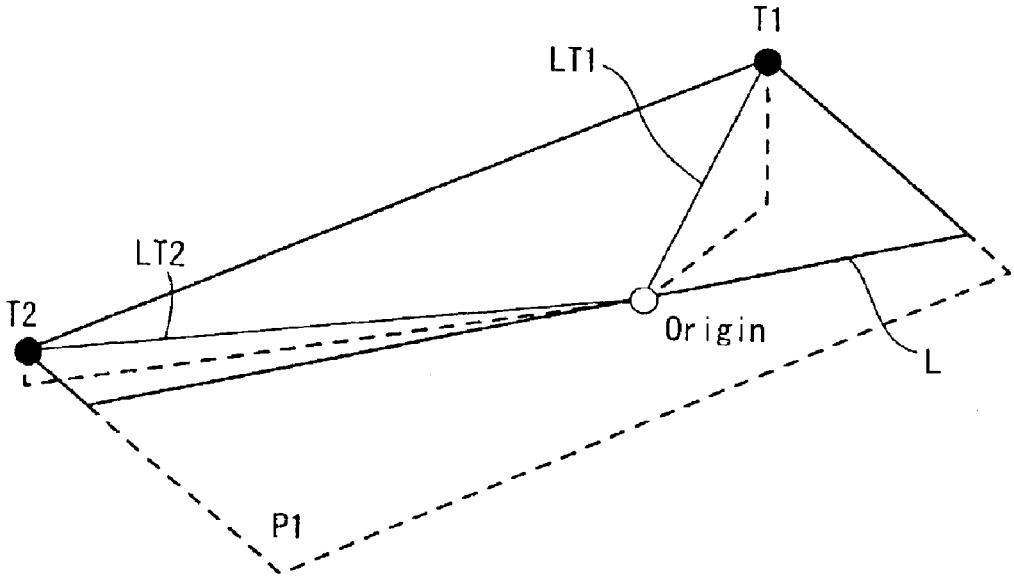
FIG. 4 is an illustrative view showing the positional relationship between antennas and two satellites acquired by the antenna.

This 3-dimentional space can be depicted as shown in FIG. 4, and the positions of the first satellite T1 and second satellite T2, straight lines including axes A, B, C1 and C2 of the antenna device, a straight line LT1 including the first satellite T1 and the origin, a straight line LT2 including the second satellite T2 and the origin, the plane P1 including three points, the first satellite T1, the second satellite T2 and the origin, the straight line L defined by plane P1 and plane Z=0 and the planes of the first antenna 33 and the second antenna 34 are represented by the following equations:

the position of the first satellite T1($x_1$, $y_1$, $z_1$)

the position of the second satellite T2($x_2$, $y_2$, $z_2$)

the straight line including axis A: x=0, y=0 the straight line including axis B: $(x/l_b)=(y/m_b)$, z=0 the straight line including axes C1 and C2:

$$(x/l_c)=(y/m_c)=(z/n_c)$$

the straight line LT1 (the straight line joining T1 and the origin):

$$(x/l_{T1})=(y/m_{T1})=(z/n_{T1})$$

the straight line LT2 (the straight line joining T2 and the origin):

$$(x/l_{T2})=(y/m_{T2})=(z/n_{T2})$$

the plane P1 (the plane including T1, T2 and the origin):

$$(y_2z_1+y_1z_2)x+(z_1((x_1y_2/y_1)-x_2)-x_1(y_2z_1+y_1z_2))y+(x_1y_2-x_2y_1)z=0$$

the straight line L (the straight line defined by plane P1 and plane Z=0)

$$x/(x_1(y_2z_1+y_1z_2)-z_1((x_1y_2/y_1)-x_2))=y/(y_2z_1+y_1z_2),\ z32\ 0$$

the plane including the first antenna: $a_1x+b_1y+c_1z=0$ the plane including the second antenna: $a_2x+b_2y+c_2z=0$ Next, the state where the first satellite T1 is acquired by the first antenna 33 and the state where the second satellite T2 is acquired by the second antenna 34 are formulated by the following four conditional expressions using the above equations.

The positional relationship between the antenna device (the origin), the first satellite T1 and second satellite T2 in this case is as shown in FIG. 4. In plane P1, the part below L is situated below the surface of the earth.

<Conditional Expression 1> The plane (plane P1) including T1, T2 and the origin overlaps axis B.

That is, the straight line (straight line L) defined by plane P1 and the plane Z=0 should coincide with axis B. This condition can be represented by the following formula:

$$\frac{x_1(y_2z_1+y_1z_2)-z_1\left(\frac{x_1y_2}{y_1}-x_2\right)}{l_b}=\frac{y_2z_1-y_1z_2}{m_b},\ z=0 \tag{1}$$

<Conditional Expression 2> Axis C(axis C1 and axis C2) is perpendicular to the plane (plane P1) including T1, T2 and the origin. This condition can be represented by the following formula:

$$\frac{y_2z_1+y_1z_2}{l_c}=\frac{z_1\left(\frac{x_1y_2}{y_1}-x_2\right)-x_1(y_2z_1+y_1z_2)}{m_c}=\frac{x_1y_2-x_2y_1}{n_c} \tag{2}$$

<Conditional Expression 3> The straight line (straight line LT1) passing through T1 and the origin is perpendicular to the first antenna. This condition can be represented by the following formula:

$$\frac{a_1}{l_{T1}}=\frac{b_1}{m_{T1}}=\frac{c_1}{n_{T1}} \tag{3}$$

<Conditional Expression 4> The straight line (straight line LT2) passing through T2 and the origin is perpendicular to the second antenna. This condition can be represented by the following formula:

$$\frac{a_2}{l_{T2}}=\frac{b_2}{m_{T2}}=\frac{c_2}{n_{T2}} \tag{4}$$

Taking into account the above definitions of acquisition, directional control of the antennas will be described.

Figure 5:
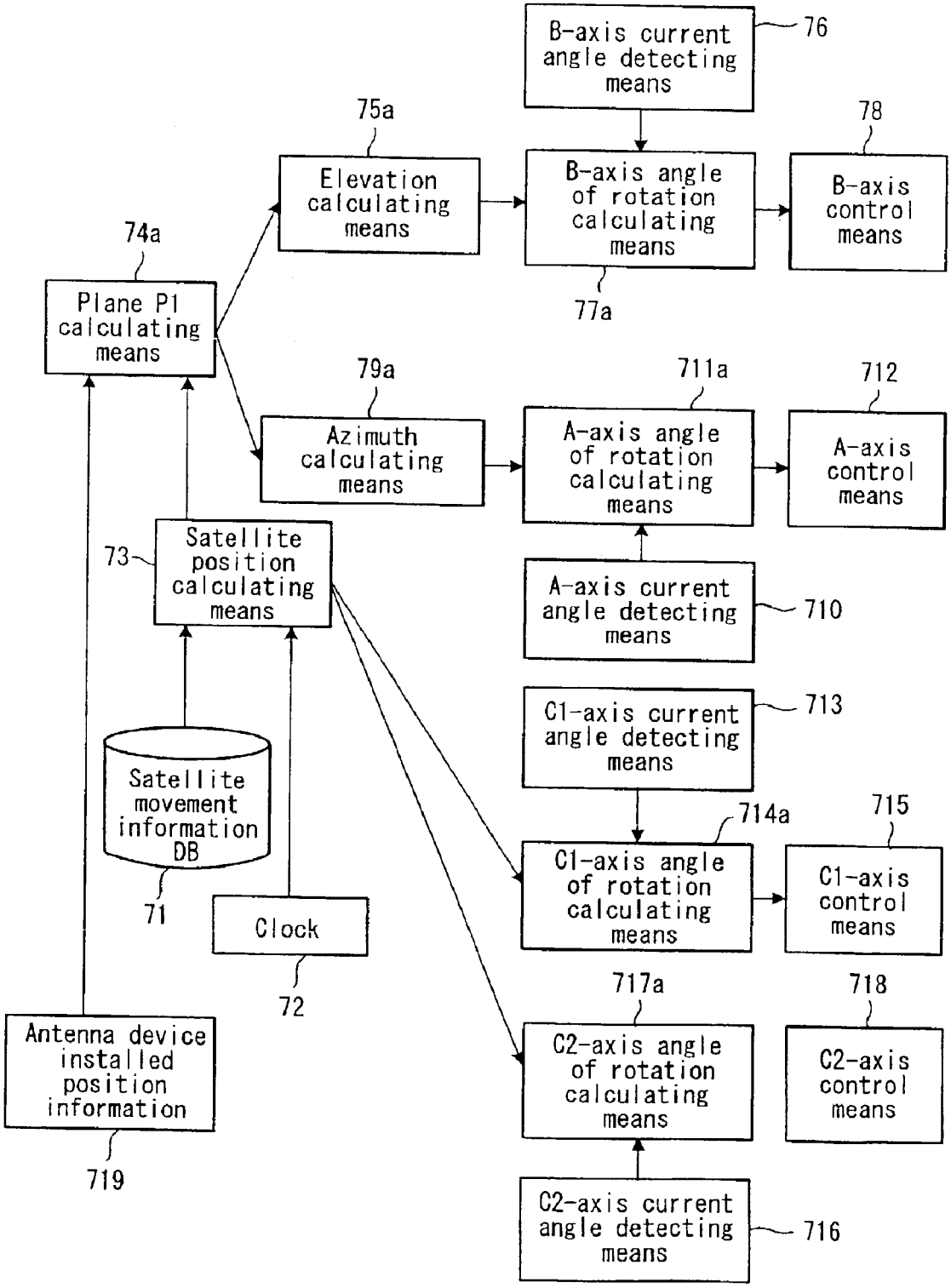
FIG. 5 is a schematic block diagram showing an antenna control system (embodiment 1) capable of controlling antennas so as to acquire two targets.

FIG. 5 is a schematic block diagram showing an antenna control system according to embodiment 1.

As shown in FIG. 5, the antenna control system according to embodiment 1 includes: a satellite position calculating means 73 for calculating the positions of the two satellites at the current time, read out from a clock 72, while referring to a satellite movement information database (DB) 71; a plane P1 calculating means 74*a* for calculating plane P1 based on the positions of the two satellites, calculated by satellite position calculating means 73 and installed position information 719 of the antenna device; an elevation calculating means 75*a* for calculating the elevation angle of the first and second arms when they orthogonally intersect the plane P1; a B-axis current angle detecting means 76 for detecting the current angle of an axis B; a B-axis angle of rotation calculating means 77*a* for calculating the required angle of rotation of axis B based on the elevation angle calculated by elevation calculating means 75*a* and the current angle of axis B detected by B-axis current angle detecting means 76; a B-axis control means 78 for rotating axis B in accordance with the B-axis angle of rotation calculated by B-axis angle of rotation calculating means 77*a*; an azimuth calculating means 79*a* for calculating the azimuth angle of the first and second arms when they orthogonally intersect the plane P1; an A-axis current angle detecting means 710 for detecting the current angle of an axis A; an A-axis angle of rotation calculating means 711*a* for calculating the required angle of rotation of axis A based on the azimuth angle calculated by azimuth calculating means 79*a* and the current angle of axis A detected by A-axis current angle detecting means 710; an A-axis control means 712 for rotating axis A in accordance with the A-axis angle of rotation calculated by A-axis angle of rotation calculating means 711*a*; a C1-axis current angle detecting means 713 for detecting the current angle of an axis C1; a C1-axis angle of rotation calculating means 714*a* for calculating the required angle of rotation of axis C1 based on the position of first satellite T1 at the current time, read out from clock 72 and the current angle of axis C1 detected by C1-axis current angle detecting means 713; a C1-axis control means 715 for rotating axis C1 in accordance with the C1-axis angle of rotation calculated by C1-axis angle of rotation calculating means 714*a*; a C2-axis current angle detecting means 716 for detecting the current angle of an axis C2; a C2-axis angle of rotation calculating means 717*a* for calculating the required angle of rotation of axis C2 based on the position of second satellite T2 at the current time, read out from clock 72 and the current angle of axis C2 detected by C2-axis current angle detecting means 716; and a C2-axis control means 718 for rotating axis C2 in accordance with the C2-axis angle of rotation calculated by C2-axis angle of rotation calculating means 717*a*.

The antenna control sequence for acquiring two satellites using the antenna control system in accordance with this embodiment 1 will be described with reference to the flowchart shown in FIG. 6.

Figure 6:
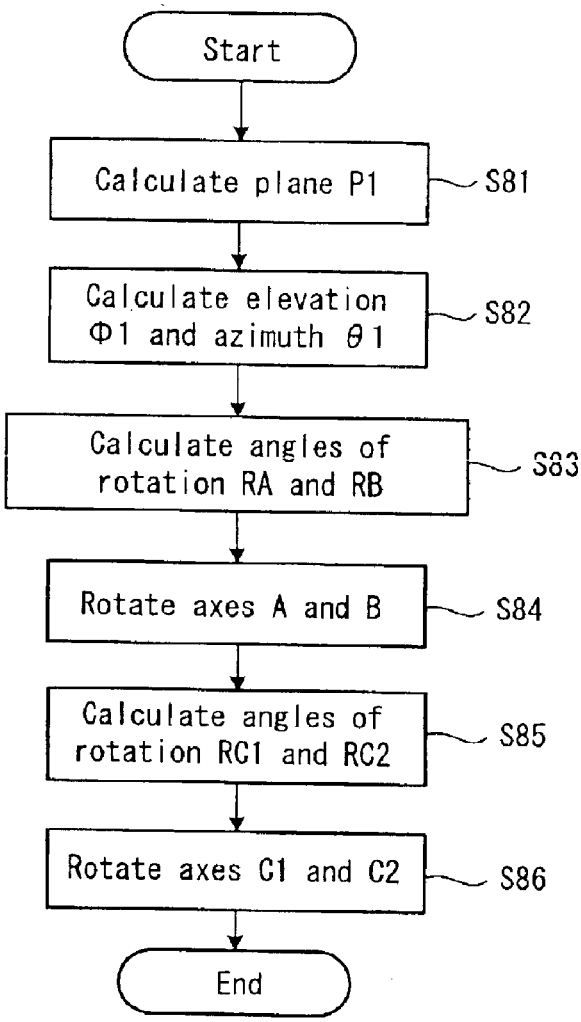
FIG. 6 is a flowchart showing the sequence in an antenna control method for acquiring two targets.

To acquire two satellites using the antenna control system in accordance with embodiment 1, plane P1 containing a triangle (T1, T2 and O) defined by the first satellite T1, the second satellite T2 and the installed position of the antenna device (the origin O) is calculated first, as shown in FIG. 6 (S81).

Then, the elevation angle $\phi$1 and azimuth angle $\theta$1 of the direction of first and second arms (axes C1 and C2) when they orthogonally intersect the plane P1 are calculated (S82).

Next, the angle of rotation RA of axis A is calculated from the azimuth angle $\theta$1 and the angle of rotation RB of axis B is calculated from the elevation angle $\phi$1 (S83).

Subsequently, axis A and axis B are rotated based on the calculated angle of rotation RA of axis A and angle of rotation RB of axis B (S84).

Then, the angle of rotation RC1 of axis C1 is calculated from the position of the first satellite T1 and the angle of rotation RC2 of axis C2 is calculated from the position of the second satellite T2 (S85).

Finally, axes C1 and C2 are rotated based on the calculated RC1 and RC2, so that the first and second antennae will be pointed towards first and second satellites T1 and T2, respectively (S86).

According to the antenna control sequence described above, it is possible to acquire two satellites at the same time, using the antenna device configured as shown in FIG. 1.

<Embodiment 2>

Next, an antenna control system according to embodiment 2 will be described.

The antenna control system according to embodiment 2 is configured so that, when the satellites having been acquired by the antenna control method shown in embodiment 1 are non-stationary satellites and hence the received signal level from one of them becomes weakened, the system is able to actuate a tracking operation in order to maintain communication.

Figure 7:
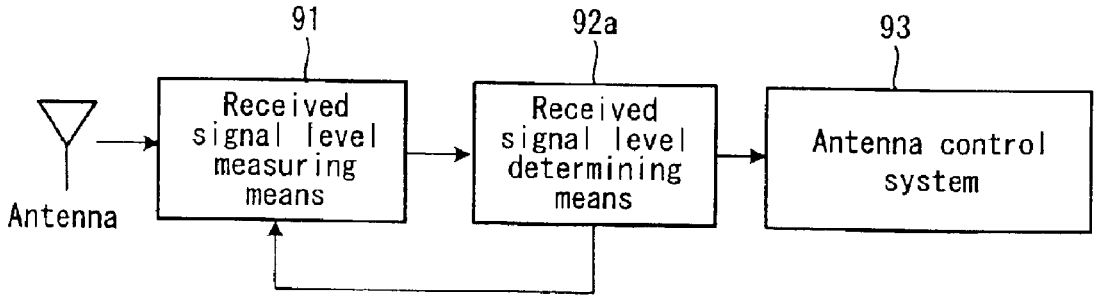
FIG. 7 is a schematic block diagram showing an antenna control system according to embodiment 2 of the present invention.

FIG. 7 shows a schematic configuration of the antenna control system according to embodiment 2.

An antenna control system 93 of embodiment 2 is comprised of, as shown in FIG. 7, a received signal level measuring means 91 for measuring the received signal level at the antenna and a received signal level determining means 92*a* for determining whether the received signal level at the antenna is greater than the predetermined reference value for actuating the tracking operation.

The tracking sequence of this antenna control system 93 according to embodiment 2 for maintaining communication with the satellite when the received signal level at the first antenna has lowered will be explained with reference to the flowchart shown in FIG. 8.

Figure 8:
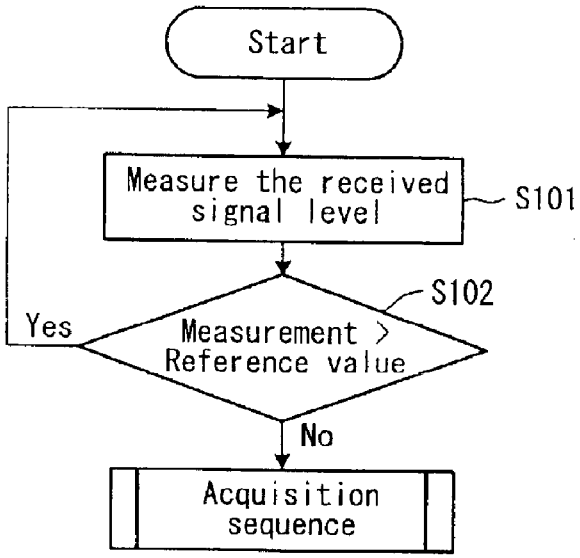
FIG. 8 is a flowchart showing the sequence for determining the timing of start of tracking in an antenna control system according to embodiment 2.

To maintain communication with the satellite using the antenna control system according to embodiment 2 when the received signal level at the first antenna has lowered, the received signal level at the first antenna is measured first (S101), as shown in FIG. 8.

Then, it is determined whether the measurement of the received signal level is greater than the predetermined reference value for actuating the tracking operation (S102). If the measurement of the received signal level is greater than the reference value, the operation returns to Step S101 to continue measuring the received signal level.

On the other hand, when the measurement of the received signal level is not greater than the reference value, the sequence of acquisition shown in FIG. 6, already explained with reference to embodiment 1, is started. Since this acquisition sequence is the same as that described in embodiment 1, the description is omitted.

According to the antenna control system described above, it is possible to determine appropriate timing of starting the tracking operation before communication with the acquired first satellite T1 and second satellite T2 becomes impossible, so that it is possible to maintain continuous communication with the first satellite T1 and second satellite T2.

<Embodiment 3>

Next, an antenna control system according to embodiment 3 will be described.

With the antenna control system according to embodiment 3, when the received signal level from the first satellite T1 having been acquired by the antenna control method shown in embodiment 1 lowers owing to an adverse change in weather conditions or the like and hence it becomes impossible for the first antenna alone to keep communication while the communication with the first satellite T1 is more important than that with the second satellite T2, tracking of the second satellite T2 by the second antenna is abandoned so that both the first and second antennae can track the first satellite T1 that is of more importance. Implementation of this tracking operation makes it possible to enhance the received signal level from the first satellite T1 and maintain communication.

Figure 9:
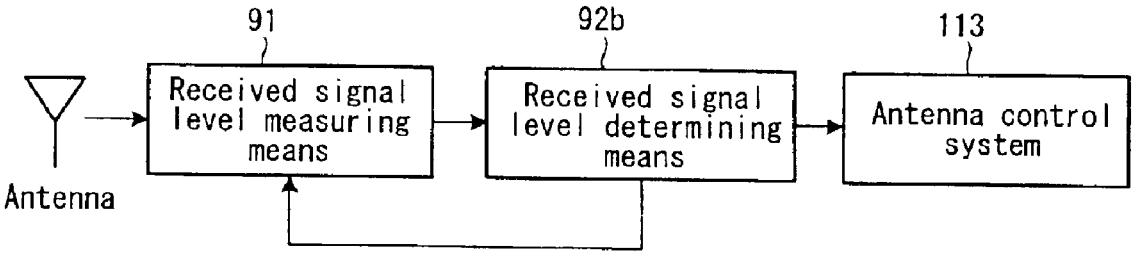
FIG. 9 is a schematic block diagram showing an antenna control system (embodiment 3) for determining the timing of start of tracking the first satellite.

FIG. 9 shows a schematic configuration of an antenna control system according to embodiment 3.

An antenna control system 113 according to embodiment 3 is comprised of, as shown in FIG. 9, a received signal level measuring means 91 for measuring the received signal level at the antenna and a received signal level determining means 92*b* for determining whether the received signal level at the antenna is greater than the predetermined reference value for actuating the tracking operation.

In this antenna control system 113 according to embodiment 3, if the received signal level does not reach above the reference level, the directions of the first and second antennae are controlled so that both the first and second antennae track one satellite.

As will be detailed later, antenna control system 113 according to embodiment 3 has any one of the configurations including: a mechanism for controlling the directions of the antennae based on axes A and B (see FIG. 11); a mechanism for controlling the directions based on axes A, C1 and C2 (see FIG. 13); and a mechanism for controlling the directions of the antennae based on axes B, C1 and C2 (see FIG. 15), so as to control the directions of the first and second antennae.

Referring to the flowchart shown in FIG. 10, the sequence of actuating both the first and second antennae to track the first satellite T1 will be described.

Figure 10:
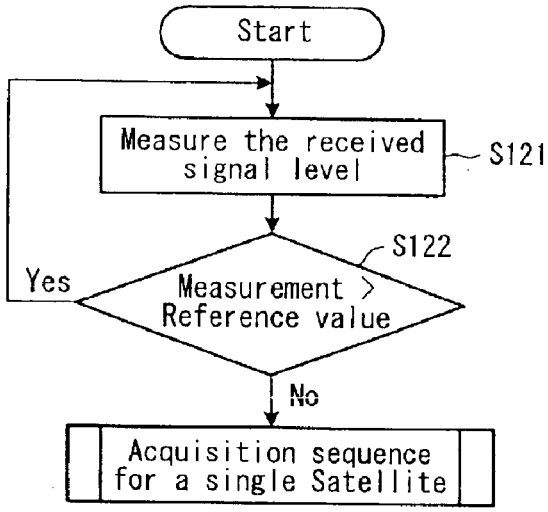
FIG. 10 is a flowchart showing the sequence for determining the timing of start of tracking the first satellite T1 in the antenna control system according to embodiment 3.

For the first and second antennae to track the first satellite T1, the received signal level at the first antenna is measured first (S121), as shown in FIG. 10.

Then, it is checked whether the received signal level at the first antenna is greater than the reference value for actuating the tracking operation with both the first and second antennae (S122).

Here, if the measurement is greater than the reference value, measurement and determination of the received signal level is repeated. When, on the other hand, the measurement of the received signal level is not greater than the reference value, track of the second satellite T2 by the second antenna is stopped so as to actuate the second antenna to also track the first satellite T1.

Here, there are three ways of antenna control for causing both the first and second antennae to track the first satellite T1 at the same time. This is because two degrees of freedom, i.e., the elevation and azimuth angles, are needed to track a single satellite, but the antenna device used in the present invention has three degrees of freedom, axis A, axis B and axis C1 and axis C2. Actually, there are three kinds of antenna control methods as follows:

(1) the antenna control method by axes A and B, by adjusting the elevation of the antennae by rotation on axis B and the azimuth by rotation on axis A with axes C1 and C2 fixed;

(2) the antenna control method by axes A, C1 and C2, by adjusting the elevation of the antennae by rotation on axes C1 and C2 and the azimuth by rotation on axis A with axis B fixed; and (3) the antenna control method by axes B, C1 and C2, by adjusting the elevation and azimuth of the antennae by combination of rotation on axes B, C1 and C2 with axis A fixed.

Next, the antenna control systems and their sequences, corresponding to the above antenna control methods (1) to (3) will be described.

First, the antenna control system and its control sequence capable of carrying out the above antenna control method (1) will be described.

Figure 11:
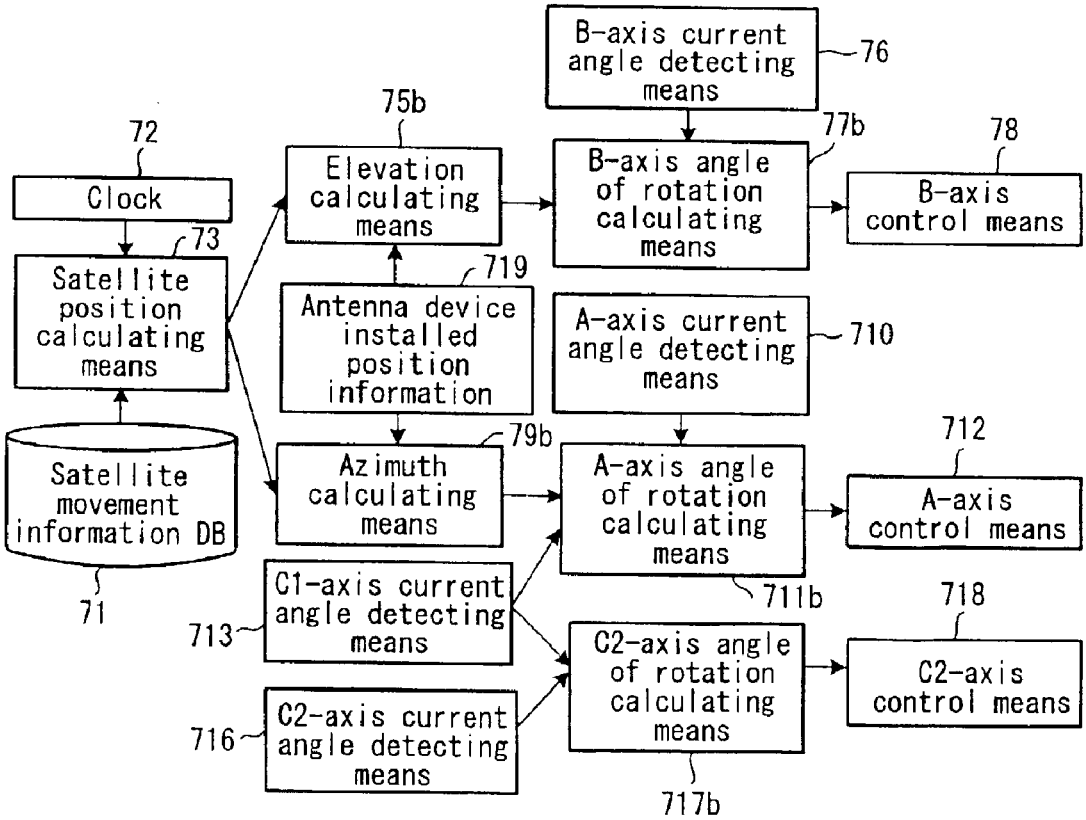
FIG. 11 is a schematic block diagram showing an antenna control system capable of implementing an antenna control method by axes A and B.
Figure 12:
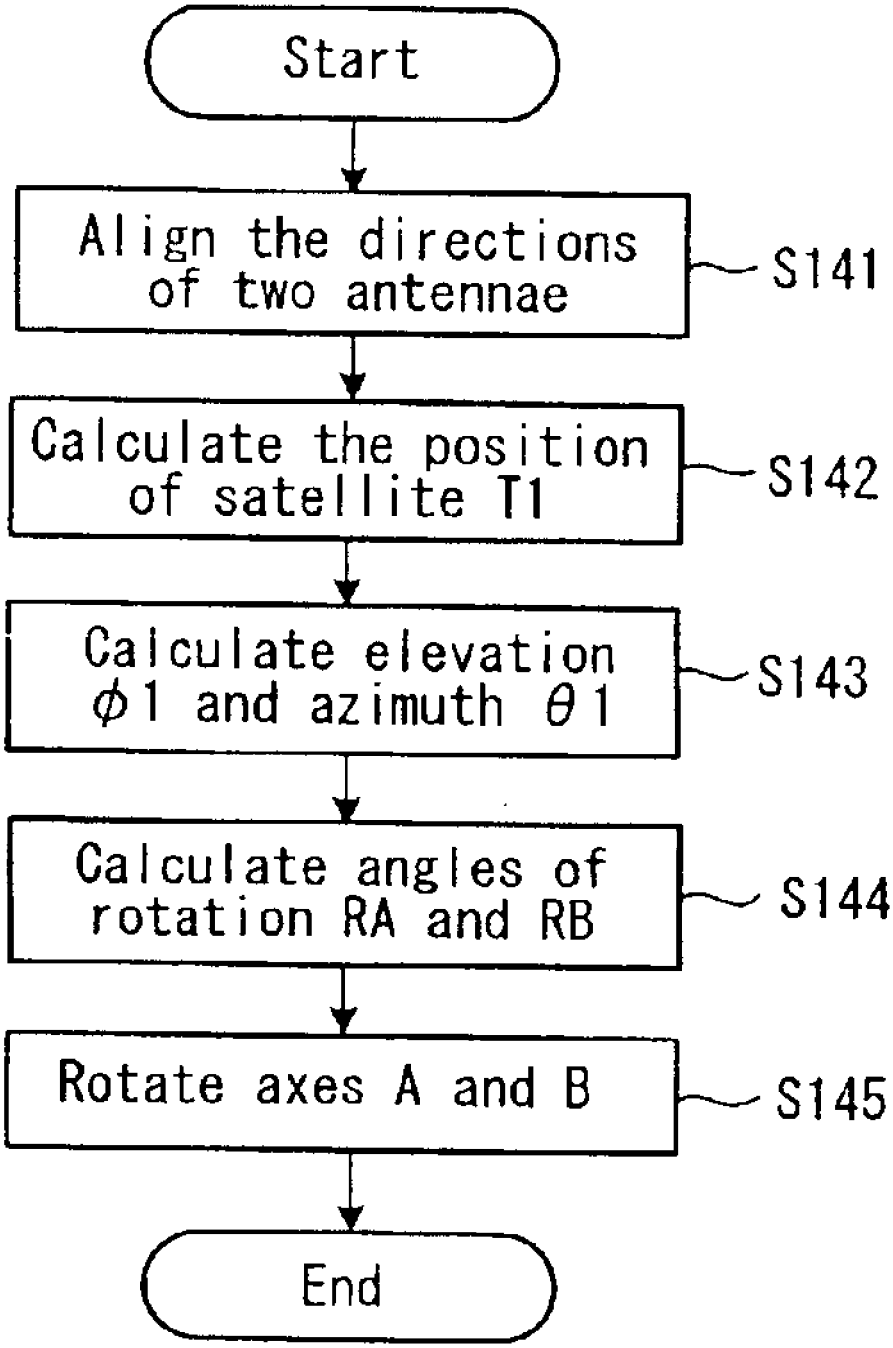
FIG. 12 is a flowchart showing the sequence of an antenna control method by axes A and B.

FIG. 11 is a schematic block diagram showing an antenna control system capable of implementing the antenna control method (1). FIG. 12 is a flowchart showing the sequence of the antenna control method (1).

The antenna control system capable of carrying out the antenna control method (1) includes: as shown in FIG. 11, a C1-axis current angle detecting means 713 for detecting the current angle of axis C1; a C2-axis current angle detecting means 716 for detecting the current angle of axis C2; a C2-axis angle of rotation calculating means 717*b* for calculating the required angle of rotation RC2 of axis C2 to align the second antenna with the first antenna, based on the current angles of axes C1 and C2; a C2-axis control means 718 for rotating axis C2 in accordance with the C2-axis angle of rotation RC2; a satellite position calculating means 73 for calculating the position of the first satellite T1 at the current time, read out from a clock 72,while referring to a satellite movement information database 71; an elevation calculating means 75*b* for calculating the antenna elevation based on the position of the first satellite T1 and installed position information 719 of the antenna device; a B-axis current angle detecting means 76 for detecting the current angle of axis B; a B-axis angle of rotation calculating means 77*b* for calculating the angle of rotation RB of axis B based on the current angle of axis B and the antenna elevation; a B-axis control means 78 for rotating axis B in accordance with the B-axis angle of rotation RB; an azimuth calculating means 79*b* for calculating the antenna azimuth based on the position of the first satellite T1 and installed position information 719 of the antenna device; an A-axis current angle detecting means 710 for detecting the current angle of axis A; an A-axis angle of rotation calculating means 711*b* for calculating the angle of rotation RA of axis A based on the current angles axes A and C1 and antenna azimuth; and an A-axis control means 712 for rotating axis A in accordance with the A-axis angle of rotation RA.

In the above antenna control method (1), as shown in FIG. 12, the direction of the second antenna is aligned with that of the first antenna (S141).

Then, the current position of the first satellite T1 is calculated (S142), and based on the position of the first satellite T1, the antenna elevation angle $\phi 1$ and azimuth angle $\theta 1$ are calculated (S143).

Subsequently, based on the current angle of axis C1 (since two antennae are pointed at the same direction, the current angle of axis C2 needs not be checked) and azimuth angle $\theta 1$, the angle of rotation RA of axis A is calculated, and based on the elevation angle $\phi 1$, the angle of rotation RB of axis B is calculated (S144).

Then, based on the calculated angle of rotations RA and RB about axes A and B, axes A and B are rotated (S145).

If axes C1 and C2 are set to 0 degrees at Step 141, Step 144 can be simplified as follows.

That is, since axes C1 and C2 are set to 0 degrees at Step 141, the angle of rotation RA of axis A can calculated based on the azimuth angle $\theta 1$ and the angle of rotation RB of axis B can be calculated based on the elevation angle $\phi 1$, at Step 144.

Next, the antenna control system and its control sequence capable of carrying out the above antenna control method (2) will be described.

Figure 13:
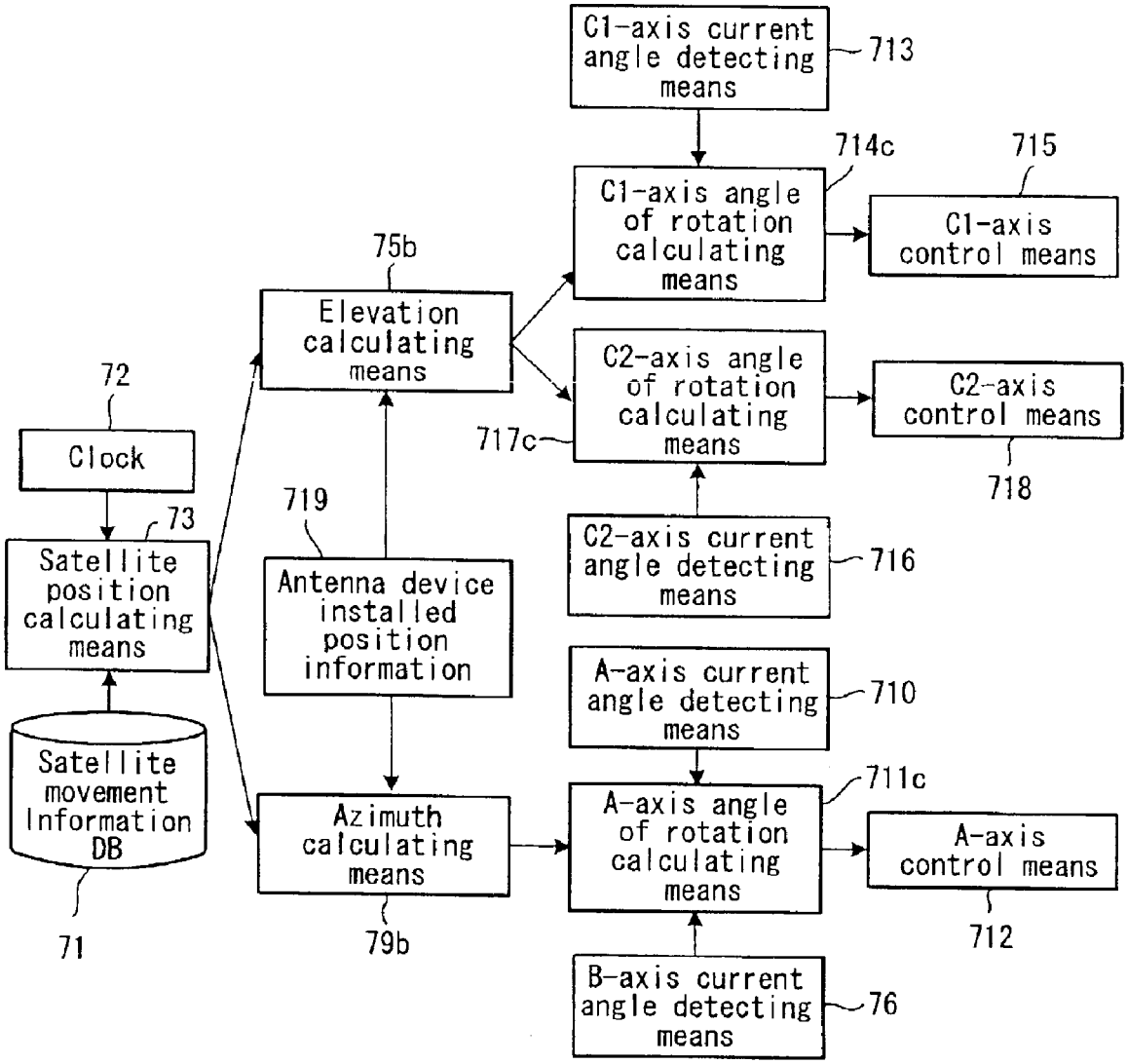
FIG. 13 is a schematic block diagram showing an antenna control system capable of implementing an antenna control method by axes A, C1 and C2.
Figure 14:
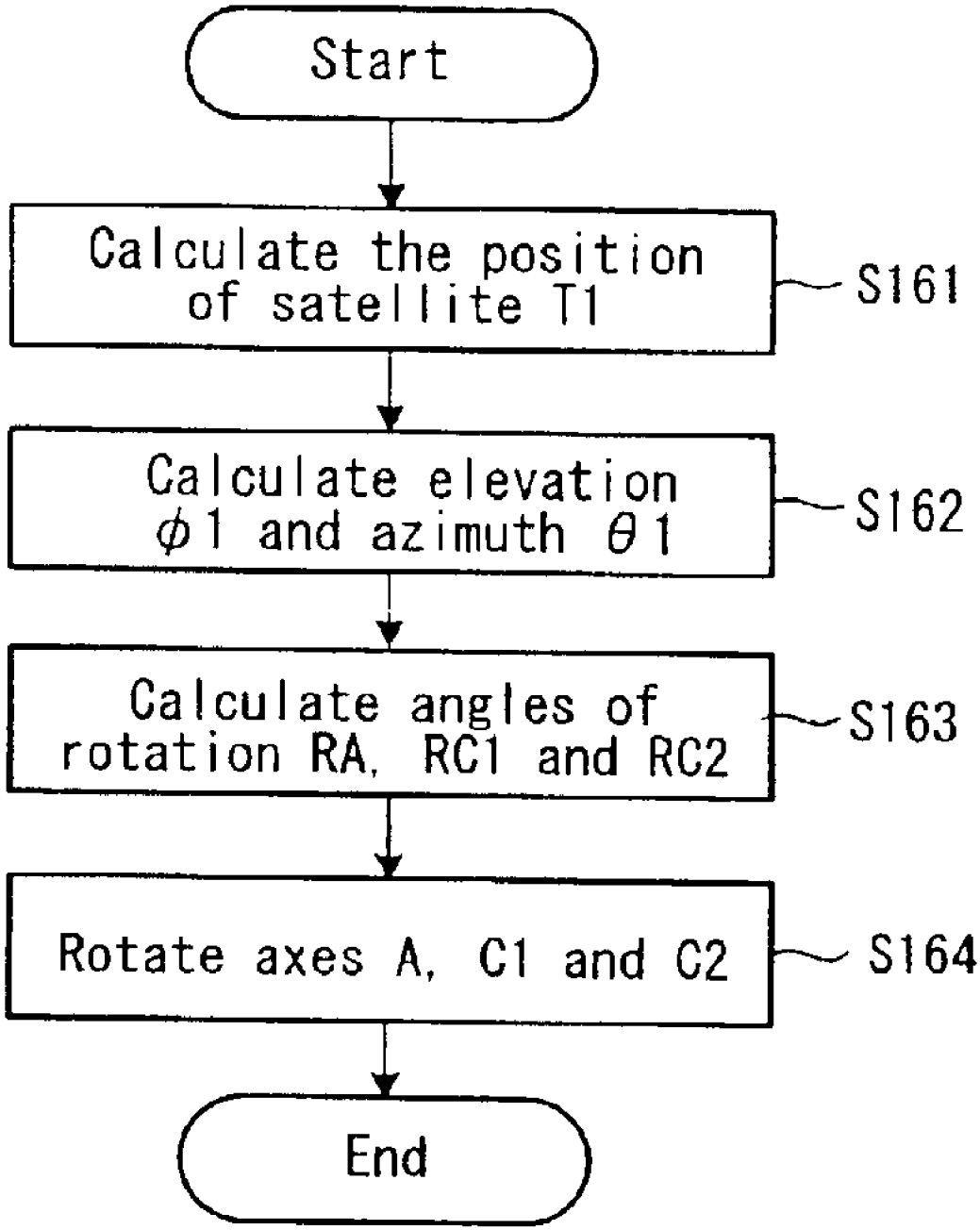
FIG. 14 is a flowchart showing the sequence of an antenna control method by axes A, C1 and C2.

FIG. 13 is a schematic block diagram showing an antenna control system capable of implementing the antenna control method (2). FIG. 14 is a flowchart showing the sequence of the antenna control method (2).

The antenna control system capable of carrying out the antenna control method (2) includes: as shown in FIG. 13, a satellite position calculating means 73 for calculating the current position of the first satellite T1 at the current time, read out from a clock 72, while referring to a satellite movement information database 71; an elevation calculating means 75*b* for calculating the antenna elevation based on the position of the first satellite T1 and installed position information 719 of the antenna device; a C1-axis current angle detecting means 713 for detecting the current angle of axis C1; a C1-axis angle of rotation calculating means 714*c* for calculating the angle of rotation RC1 of axis C1 based on the antenna elevation and the current angle of axis C1; a C1-axis control means 715 for rotating axis C1 in accordance with the C1-axis angle of rotation RC1; a C2-axis current angle detecting means 716 for detecting the current angle of axis C2; a C2-axis angle of rotation calculating means 717*c* for calculating the angle of rotation RC2 of axis C2, based on the antenna elevation and the current angle of axis C2; a C2-axis control means 718 for rotating axis C2 in accordance with the C2-axis angle of rotation RC2; an azimuth calculating means 79*b* for calculating the azimuth angle of satellite T1, based on the position of the first satellite T1 and installed position information 719 of the antenna device; an A-axis current angle detecting means 710 for detecting the current angle of axis A; a B-axis current angle detecting means 76 for detecting the current angle of axis B; an A-axis angle of rotation calculating means 711*c* for calculating the angle of rotation RA of axis A, based on the current angles axes A and B and the antenna azimuth; and an A-axis control means 712 for rotating axis A in accordance with the A-axis angle of rotation RA.

In the above antenna control method (2), as shown in FIG. 14, the current position of the first satellite T1 is calculated (S161).

Then, based on the position of the first satellite T1, the elevation angle ϕ1 and azimuth angle θ1 are calculated (S162), and based on azimuth angle θ1, the angle of rotation RA of axis A is calculated, and based on the elevation angle ϕ1, the angle of rotations RC1 and RC2 of axes C1 and C2 are calculated (S163).

Further, based on the calculated angle of rotations RA, RC1 and RC2 of axes A, C1 and C2, axes A, C1 and C2 are rotated (S164).

Next, the antenna control system and its control sequence capable of carrying out the above antenna control method (3) will be described.

Figure 15:
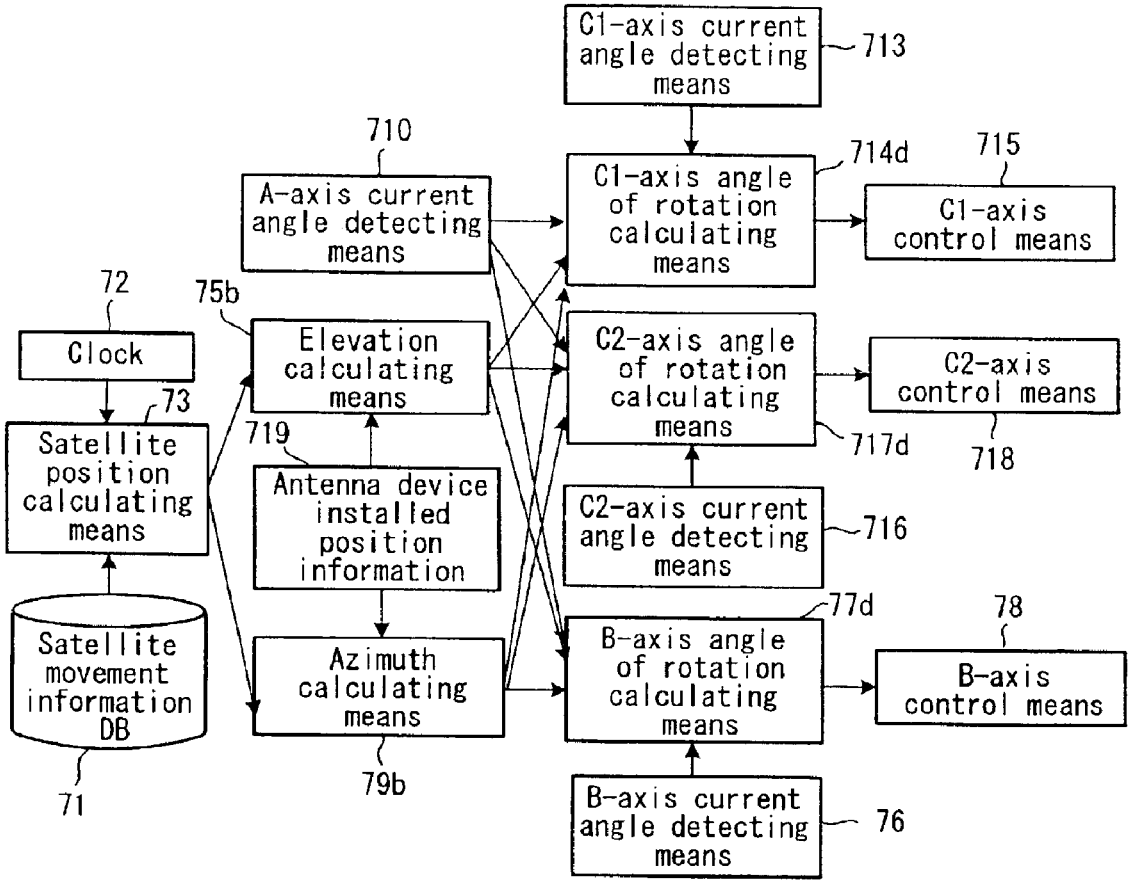
FIG. 15 is a schematic block diagram showing an antenna control system capable of implementing an antenna control method by axes B, C1 and C2.
Figure 16:
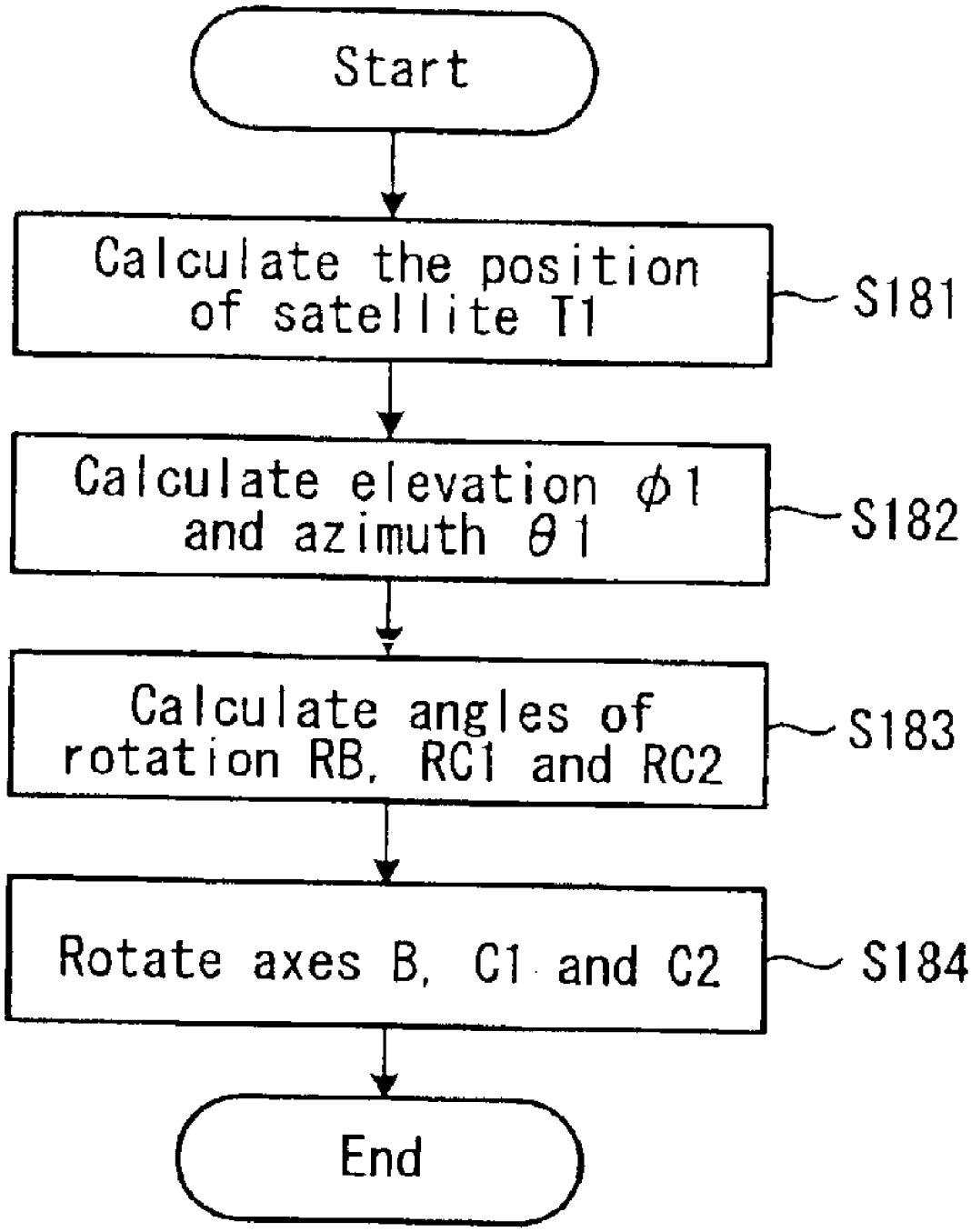
FIG. 16 is a flowchart showing the sequence of an antenna control method by axes B, C1 and C2.

FIG. 15 is a schematic block diagram showing an antenna control system capable of implementing the antenna control method (3). FIG. 16 is a flowchart showing the sequence of the antenna control method (3).

The antenna control system capable of carrying out the antenna control method (3) includes: as shown in FIG. 15, a satellite position calculating means 73 for calculating the current position of the first satellite T1 at the current time, read out from a clock 72, while referring to a satellite movement information database 71; an elevation calculating means 75*b* for calculating the elevation of the first satellite T1, based on the position of the first satellite T1 and installed position information 719 of the antenna device; an azimuth calculating means 79*b* for calculating the azimuth angle of satellite T1, based on the position of the first satellite T1 and installed position information 719 of the antenna device; an A-axis current angle detecting means 710 for detecting the current angle of axis A; a C1-axis current angle detecting means 713 for detecting the current angle of axis C1; a C1-axis angle of rotation calculating means 714*d* for calculating the angle of rotation RC1 of axis C1, based on the elevation and azimuth of the first satellite T1, the current angle of axis A and the current angle of axis C1; a C1-axis control means 715 for rotating axis C1 in accordance with the C1-axis angle of rotation RC1; a C2-axis current angle detecting means 716 for detecting the current angle of axis C2; a C2-axis angle of rotation calculating means 717*d* for calculating the angle of rotation RC2 of axis C2, based on the elevation and azimuth of the first satellite T1, the current angle of axis A and the current angle of axis C2; a C2-axis control means 718 for rotating axis C2 in accordance with the C2-axis angle of rotation RC2; a B-axis current angle detecting means 76 for detecting the current angle of axis B; a B-axis angle of rotation calculating means 77*d* for calculating the angle of rotation RB of axis B, based on the elevation and azimuth of the first satellite T1, the current angle of axis A and the current angle of axis B; and a B-axis control means 78 for rotating axis B in accordance with the B-axis angle of rotation RB.

In the above antenna control method (3), as shown in FIG. 16, the current position of the first satellite T1 is calculated (S181).

Then, based on the position of the first satellite T1, the elevation angle ϕ1 and azimuth angle θ1 are calculated (S182), and based on the elevation angle ϕ1, azimuth angle θ1 and the current angle of axis A, the angle of rotations, RB, RC1 and RC2 of axes B, C1 and C2 are calculated (S183).

Further, based on the calculated angle of rotations RB, RC1 and RC2 of axes B, C1 and C2, axes B, C1 and C2 are rotated (S184).

According to the antenna control method of embodiment 3 described above, since, of the first and second satellites T1 and T2 to be tracked, before the received signal level from the first satellite T1, which has been given higher tracking priority, lowers and results in loss of communication, the second antenna which tracks the second satellite T2 that has been given lower priority than the first satellite T1 is directed to back up the communication with the first satellite T1, whereby it is possible to maintain communication with the first satellite T1, without disconnection.

<Embodiment 4>

Next, an antenna control system according to embodiment 4 will be described.

The antenna control system according to embodiment 4 is a configuration which, in a situation where the first and second antennae are being used to track the first satellite T1 because communication with the second satellite T2 has been abandoned by the antenna control method described in embodiment 3, if the communication status with the first satellite T1 through the first antenna alone has recovered to the valid state, tracking of the first satellite T1 by the second antenna is canceled so that tracking of the second satellite T2 will be restarted.

Figure 17:
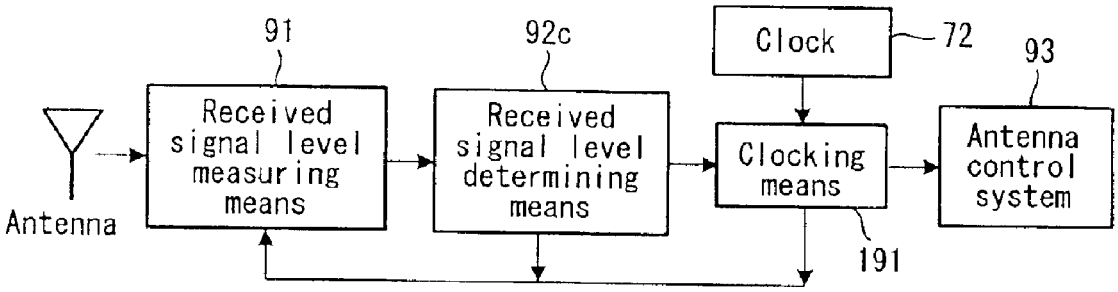
FIG. 17 is a schematic block diagram showing an antenna control system according to embodiment 4.

FIG. 17 shows a schematic configuration of an antenna control system according to embodiment 4.

An antenna control system 93 according to embodiment 4 is comprised of, as shown in FIG. 17, a received signal level measuring means 91 for measuring the received signal level at the antenna; a received signal level determining means 92*c* for determining whether the received signal level at the antenna is greater than the predetermined reference value for actuating the tracking operation; and a clock 72 and clocking means 191 for measuring the time during which the received signal level at the antenna continuously exceeds the predetermined reference value for actuating the tracking operation.

Referring to the flowchart shown in FIG. 18, the sequence for restarting tracking of the second satellite T2 will be described.

Figure 18:
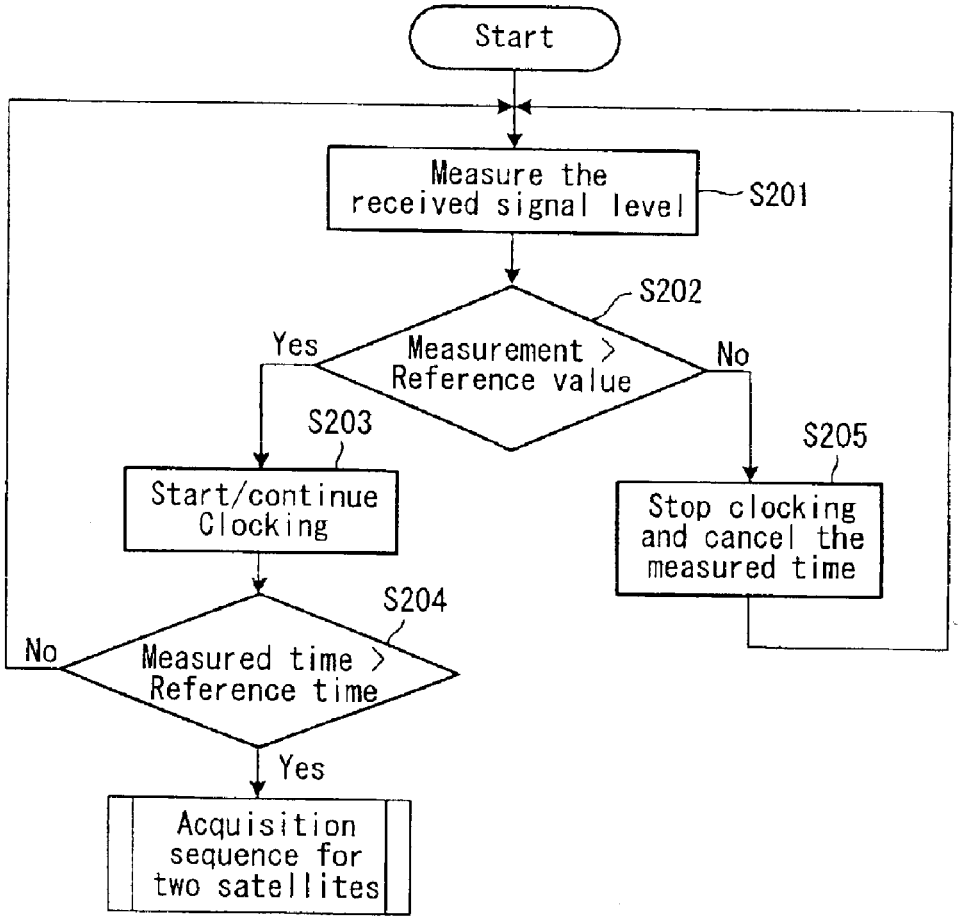
FIG. 18 is a flowchart showing the sequence of restarting tracking the second satellite T2 by the second antenna.

To restart tracking the second satellite T2, the received signal level from the first satellite T1 is measured first (S201), as shown in FIG. 18.

Then, the measured received signal level is compared with the predetermined reference value for restarting tracking of the second satellite T2 (S202).

At this step, when the measured value is greater than the reference value, clocking is started (if clocking has already started, clocking is continued as is) (S203).

Subsequently, it is determined whether the measured time exceeds the reference time (S204). At this step, when the measured time exceeds the reference time, the acquisition sequence (the same sequence described in embodiment 1 with reference to FIG. 6) is started. When the measured time has not yet exceeded the reference time, the operation returns to Step 201 where the received signal level maintains being measured.

On the other hand, when it is determined that the measured value is not greater than the reference value at Step 202, the operation returns to Step 201 without starting clocking (if clocking has already started, the operation returns to Step S201 after clocking is stopped and the measured time up to that point is cancelled) and the measurement of the received signal level is continued (S205).

According to the antenna control method of embodiment 4 described heretofore, in a situation where both the first and second antennae are being used to track the first satellite T1, it is possible to appropriately determine the time when the communication status has become valid through the first antenna alone, so that communication with the second satellite T2 can be smoothly restarted.

<Embodiment 5>

Next, an antenna control system according to embodiment 5 will be described.

The antenna control system according to embodiment 5 is a configuration in which, when the number of the satellite positions to be tracked, calculated by satellite position calculating means is one, both the first and second antennae are adapted to track the single satellite.

The antenna control system according to embodiment 5 is able to acquire the single satellite by both the first and second antennae, using the any one of antenna control systems shown in FIGS. 11, 15 and 17. So, the description of the antenna control system of embodiment 5 is omitted.

The sequence of the antenna control system according to embodiment 5 for acquiring a single satellite by both the first and second antennae will be described with reference to the flowchart shown in FIG. 19.

Figure 19:
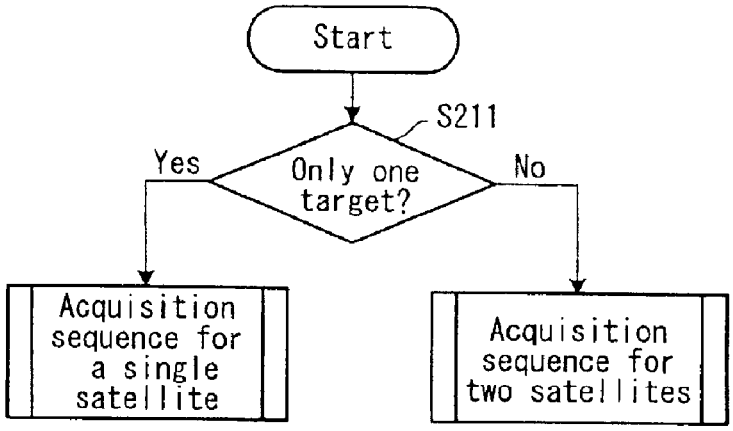
FIG. 19 is a flowchart showing the sequence of acquiring one satellite by the first and second antennae.

To acquire a single satellite by both the first and second antennae, it is checked first whether the number of satellites to be tracked is one, as shown in FIG. 19 (S211).

Here, if the number of satellites to be tracked is one, the sequence for acquiring a single satellite described in the above embodiment 3 is started. When there are two satellites to be tracked, the sequence for acquiring two satellites described in the above embodiment 1 is started.

According to the antenna control method of embodiment 5 stated above, when the number of satellites is one, the satellite can be tracked by both the first and second antennae, whereby it is possible to establish communication at higher transmitted and received signal levels compared to the case where the satellite is tracked by a single antenna.

<Embodiment 6>

Next, an antenna control system according to embodiment 6 will be described.

The antenna control system according to embodiment 6 is adapted to be able to switch the first and second satellites which have been acquired respectively by the first and second antennae using the antenna control method shown in embodiment 1, into the first and third satellites T1 and T3 (located in a direction different from T2).

Figure 20:
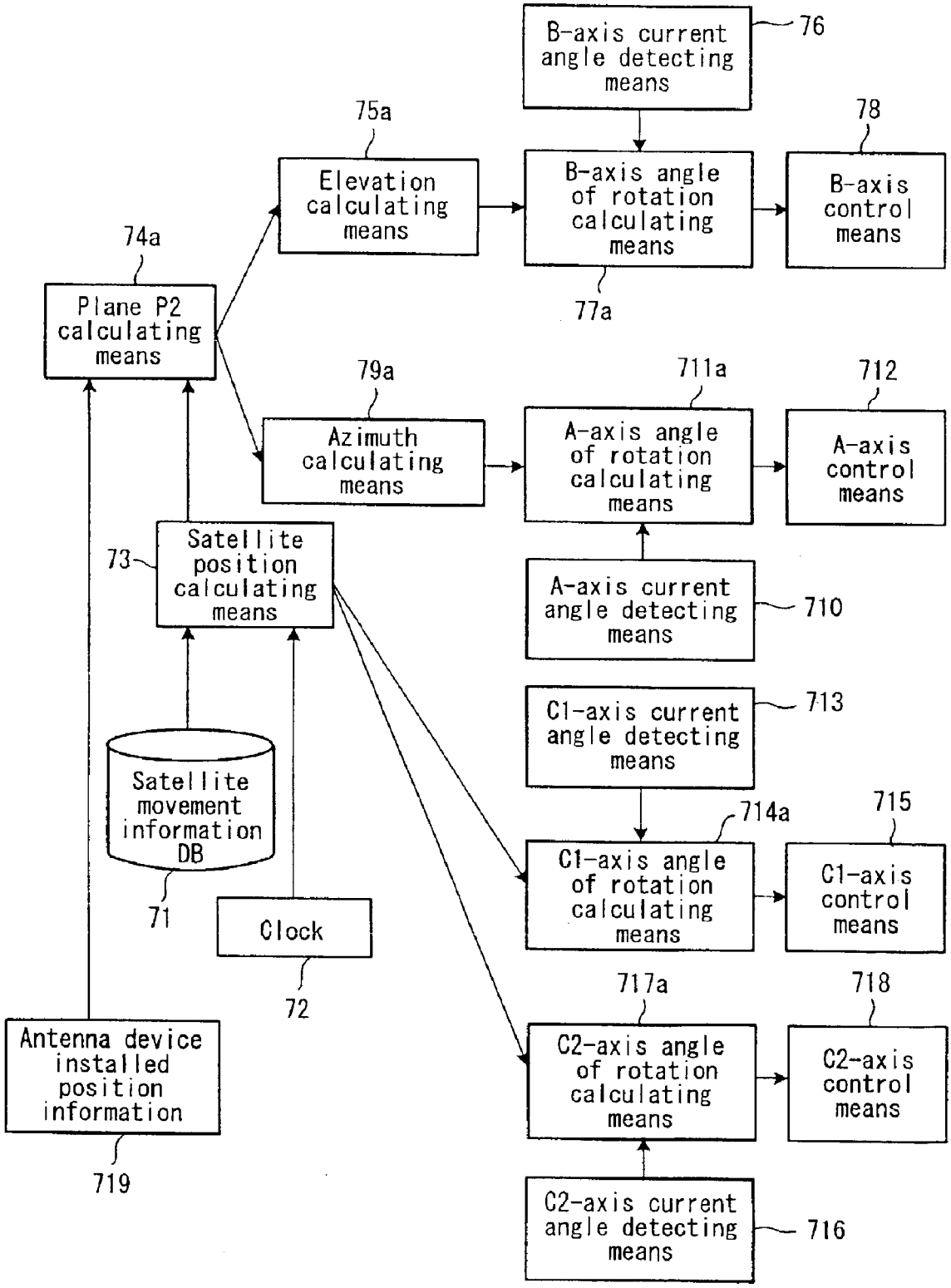
FIG. 20 is a schematic block diagram showing an antenna control system according to embodiment 6.
Figure 22:
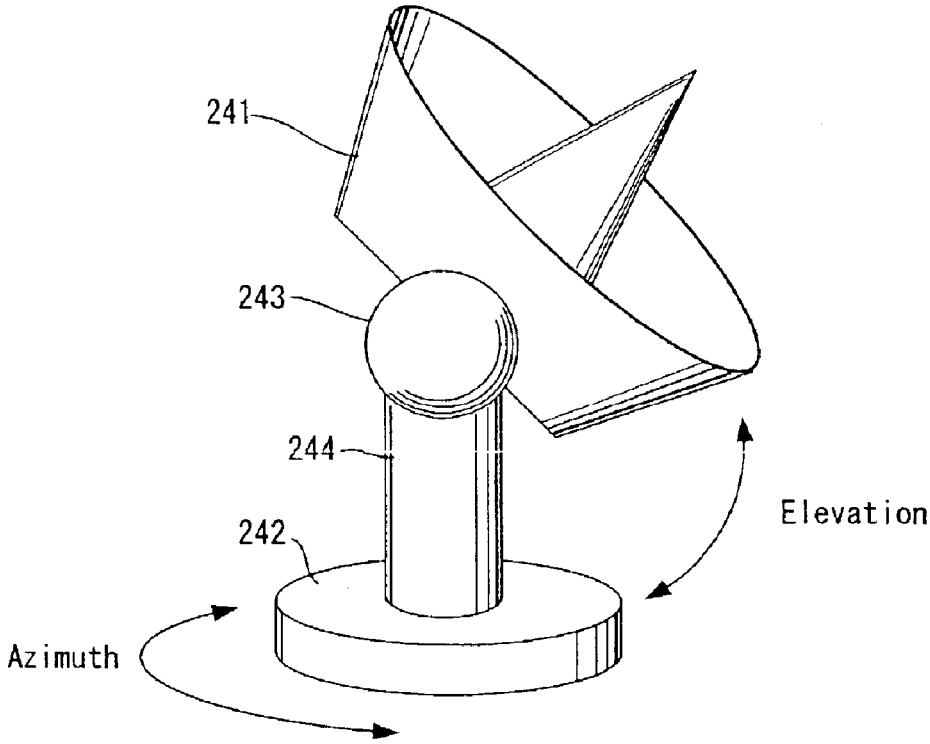
FIG. 22 is an overall structural view showing a conventional antenna system capable of establishing communication with one communication target.
Figure 23:
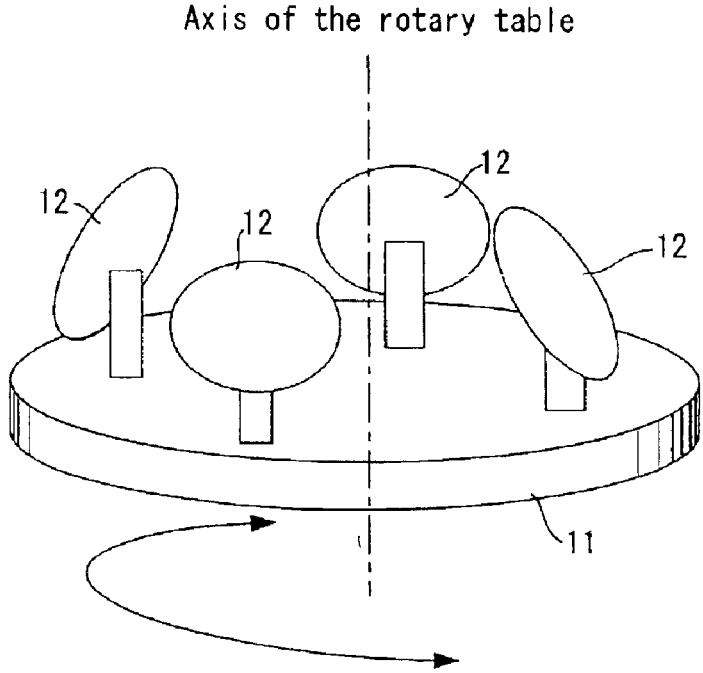
FIG. 23 is an overall structural view showing a conventional antenna system capable of establishing concurrent communication with a multiple number of communication targets.
Figure 24:
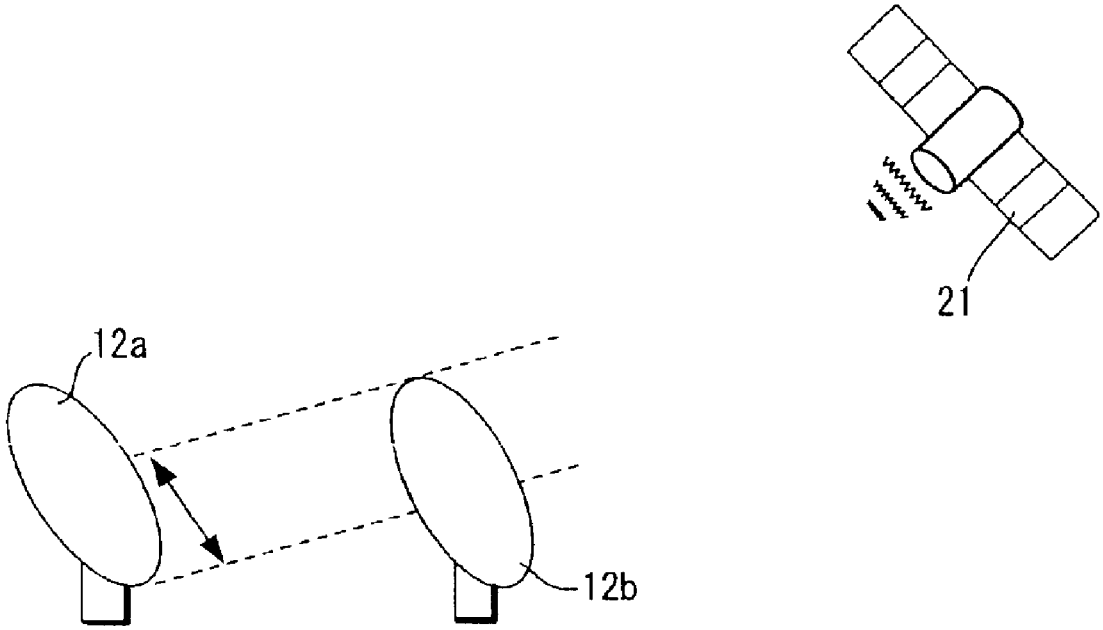
FIG. 24 is an illustrative view showing a situation where one antenna obstructs another antenna in the antenna system illustrated in FIG. 1.

FIG. 20 shows a schematic configuration of an antenna control system according to embodiment 6.

As shown in FIG. 20, the antenna control system according to embodiment 6 includes: a satellite position calculating means 73 for calculating the positions of the first and third satellites T1 and T3 at the current time, read out from a clock 72, while referring to a satellite movement information database 71; a plane P2 calculating means 74*e* for calculating the plane P2, based on the positions of the first satellite T1 and the third satellite T3 calculated by satellite position calculating means 73 and installed position information 719 of the antenna device; an elevation calculating means 75*a* for calculating the elevation angle $\phi$2 of the first and second arms when they orthogonally intersect the plane P2; a B-axis angle of rotation calculating means 77*a* for calculating the required angle of rotation RB of axis B based on the elevation angle $\phi$2 calculated by elevation calculating means 75*a* and the current angle of axis B detected by a B-axis current angle detecting means 76; an azimuth calculating means 79*a* for calculating the azimuth angle $\theta$2 of the first and second arms when they orthogonally intersect the plane P2; an A-axis angle of rotation calculating means 711*a* for calculating the required angle of rotation RA of axis A, based on the azimuth angle 02 calculated by azimuth calculating means 79*a* and the current angle of axis A detected by A-axis current angle detecting means 710; a C1-axis angle of rotation calculating means 714*a* for calculating the angle of rotation RC1 of axis C1, based on the difference between the current azimuth of the first antenna (i.e., the azimuth of T1) and the azimuth of the first antenna when axis A is rotated so that the azimuth is equal to $\theta$2; a C2-axis angle of rotation RC2 calculating means 717*a* for calculating the angle of rotation of axis C2 based on the difference between the direction of the third satellite T3 and the direction of the second antenna when axis A is rotated so that the azimuth is equal to $\theta$2; an A-axis control means 712 and B-axis control means 78 for rotating axes A and B in accordance with the calculated angles of rotations RA and RB of axes A and B; a C1-axis control means 715 for rotating axis C1 in accordance with the calculated C1-axis angle of rotation RC1 at the same time the axes A and B are rotated, so as to make up for the influence on the direction of the first antenna that is being pointed at the first satellite T1 due to change of the elevation and azimuth of the arm; and a C2-axis control means 718 for rotating axis C2 in accordance with the calculated RC2 so that the second antenna is pointed at the third satellite T3.

The sequence of switching the first and second satellites T1 and T2 which have been acquired respectively by the first and second antennae, into the first and third satellites T1 and T3 (located in a direction different from T2) will be described with reference to the flowchart shown in FIG. 21.

Figure 21:
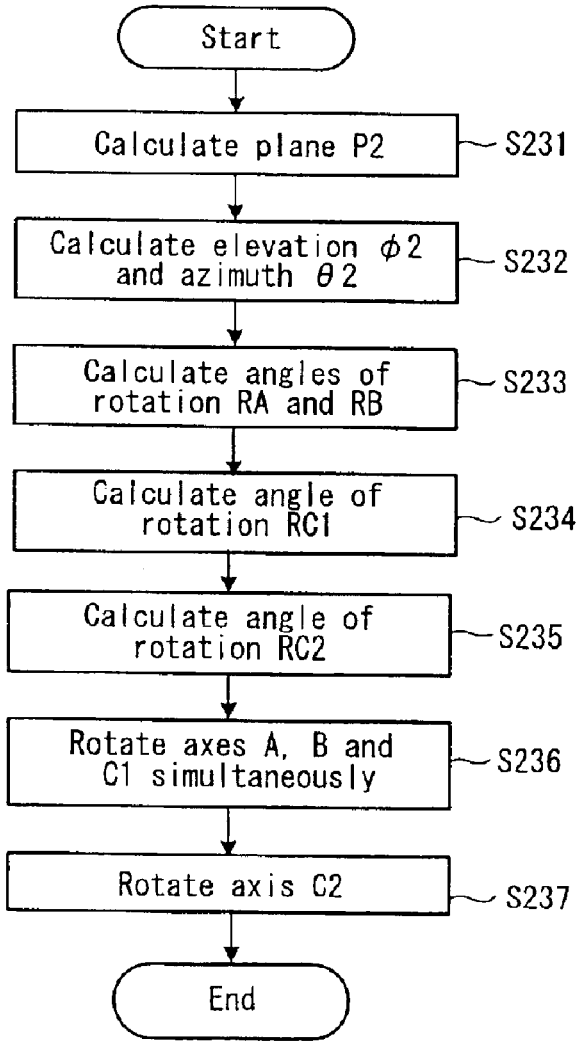
FIG. 21 is a flowchart showing the sequence of switching the satellite to be tracked.

To switch the first and second satellites T1 and T2 which have been acquired respectively by the first and second antennae, into the first and third satellites T1 and T3 (located in a direction different from T2), the plane P2 that contains a triangle (T1, T3 and O) defined by the first and third satellites T1 and T3 and the installed position of the antenna device (the origin O) is calculated first, as shown in FIG. 21 (S231).

Then, the elevation angle $\phi$2 and azimuth angle $\theta$2 of the direction of first and second arms (axes C1 and C2) when they orthogonally intersect the plane P2 are calculated (S232).

Next, based on the azimuth angle $\theta$2 and the elevation angle $\phi$2, the angle of rotation RA of axis A and the angle of rotation RB of axis B are calculated respectively (S233).

Subsequently, the difference between the current azimuth of the first antenna (i.e., the azimuth of T1) and the azimuth of the first antenna when axis A is rotated by RA with axis C1 fixed is calculated as the angle of rotation RC1 of axis C1 (S234).

Then, the difference between the azimuth of the third satellite T3 and the azimuth of the second antenna when axis A is rotated by RA with axis C2 fixed is calculated as the angle of rotation RC2 of axis C2 (S235).

Further, while axes A and B are rotated in accordance with the calculated angles of rotations RA and RB of axes A and B, axis C1 is rotated in accordance with the calculated angle of rotation RC1 of axis C1 so that the direction of the first antenna being pointed at the first satellite T1 remains as is, canceling the influence on the direction of the antenna due to change of the elevation and azimuth of the arm (S236).

Finally, in accordance with the calculated RC2, axis C2 is rotated so that the second antenna is pointed toward the third satellite T3 (S237).

According to the antenna control method of embodiment 6 described above, it is possible to switch the communication target of the second antenna from the second satellite T2 to the third satellite T3 while keeping communication by the first antenna with the first satellite T1.

INDUSTRIAL APPLICABILITY

As has been described heretofore, according to the antenna control systems and control methods of the present invention, in the antenna device for establishing concurrent communication with multiple communication targets, it is possible to reduce the manufacturing cost without increase in size and weight of the device.

Since enlargement of the device is nullified, the device becomes easy to transport and install.

Further, it is possible to easily establish concurrent communication with a multiple number of communication targets without needing any complicated control procedure.

What is claimed is:

1. An antenna control system for use in a communication system made up of combination of an antenna device and communication targets, the antenna device of which the positional information being known, comprising:

first and second arms, which are arranged in parallel and in a non-opposing manner on the same plane, respectively having axes C1 and C2 along the same direction;

a first antenna which is supported by the first arm so that the attitude can be directed arbitrarily with respect to the axis C1;

a second antenna which is supported by the second arm so that the attitude can be directed arbitrarily with respect to the axis C2;

a first rotating mechanism for rotating the first antenna about the axis C1;

a second rotating mechanism for rotating the second antenna about the axis C2;

an arm elevation adjustment mechanism for common adjustment of the first arm and second arm; and an arm azimuth adjustment mechanism for common adjustment of the first arm and second arm, the communication targets including two communication targets T1 and T2 of which the positional information or movement information is known, the antenna control system comprising:

a first rotational angle detecting means for detecting the rotational angle of the first rotating mechanism;

a first rotating mechanism control means for controlling the first rotating mechanism;

a second rotational angle detecting means for detecting the rotational angle of the second rotating mechanism;

a second rotating mechanism control means for controlling the second rotating mechanism;

an elevation detecting means for detecting the elevation angle of the arm elevation adjustment mechanism;

an arm elevation adjustment mechanism control means for controlling the arm elevation adjustment mechanism;

an azimuth detecting means for detecting the azimuth angle of the arm azimuth adjustment mechanism;

an arm azimuth adjustment mechanism control means for controlling the arm azimuth adjustment mechanism;

a means D for calculating the plane P containing a triangle defined by the two communication targets T1 and T2 and the installed position of the antenna device, based on the installed position of the antenna device, represented by the latitude, longitude and height and the positional information of the two communication targets T1 and T2;

a means E1 for calculating the elevation angle $\phi$ of the first and second arms when they orthogonally intersect the plane P, based on the calculation result from the means D;

a means E2 for calculating the azimuth angle $\theta$ of the first and second arms when they orthogonally intersect the plane P, based on the calculation result from the means D;

a means F1 for calculating the required angle of rotation RB of axis B that is orthogonal to the axes C1 and C2 so that the elevation angle of the first and second arms will be set at $\phi$, based on the current elevation of the first and second arms, detected by the elevation detecting means and the calculation result from the means E1;

a means F2 for calculating the required angle of rotation RA of axis A that is orthogonal to the axis B as well as to the axes C1 and C2 so that the azimuth angle of the first and second arms will be set at $\theta$, based on the current azimuth of the first and second arms, detected by the azimuth detecting means and the calculation result from the means E2;

a means F3 for calculating the required angle of rotation RC1 of the axis C1 so that the first antenna is pointed at the communication target T1 when the elevation angle and azimuth angle of the first and second arms are set at $\phi$ and at $\theta$; and a means F4 for calculating the required angle of rotation RC2 of the axis C2 so that the second antenna is pointed at the communication target T2 when the elevation angle and azimuth angle of the first and second arms are set at $\phi$ and at $\theta$, characterized in that, based on the calculation results from the means F1, F2, F3 and F4, the elevation adjustment mechanism, the azimuth adjustment mechanism, the first rotating mechanism and the second rotating mechanism are controlled so that the first antenna and the second antenna can be pointed towards the communication targets T1 and T2, respectively.

2. The antenna control system according to claim 1, characterized in that the antenna device further comprises: a first received signal level measuring means for measuring the received signal level at the first antenna; and a second received signal level measuring means for measuring the received signal level at the second antenna and that the timing of start of tracking is determined based on the received signal levels measured by the first received signal level measuring means and the second received signal level measuring means.

3. An antenna control method for controlling the antenna control system for use in a communication system made up of combination of an antenna device and communication targets, the antenna device of which the positional information being known, comprising:

first and second arms, which are arranged in parallel and in a non-opposing manner on the same plane, respectively having axes C1 and C2 along the same direction;

a first antenna which is supported by the first arm so that the attitude can be directed arbitrarily with respect to the axis C1;

a second antenna which is supported by the second arm so that the attitude can be directed arbitrarily with respect to the axis C2;

a first rotating mechanism for rotating the first antenna about the axis C1;

a second rotating mechanism for rotating the second antenna about the axis C2;

an arm elevation adjustment mechanism for common adjustment of the first arm and second arm; and an arm azimuth adjustment mechanism for common adjustment of the first arm and second arm, the communication targets including two communication targets T1 and T2 of which the positional information or movement information is known, the antenna control system comprising:

a first rotational angle detecting means for detecting the rotational angle of the first rotating mechanism;

a first rotating mechanism control means for controlling the first rotating mechanism;

a second rotational angle detecting means for detecting the rotational angle of the second rotating mechanism;

a second rotating mechanism control means for controlling the second rotating mechanism;

an elevation detecting means for detecting the elevation angle of the arm elevation adjustment mechanism;

an arm elevation adjustment mechanism control means for controlling the arm elevation adjustment mechanism;

an azimuth detecting means for detecting the azimuth angle of the arm azimuth adjustment mechanism;

an arm azimuth adjustment mechanism control means for controlling the arm azimuth adjustment mechanism;

a means D for calculating the plane P containing a triangle defined by the two communication targets T1 and T2 and the installed position of the antenna device, based on the installed position of the antenna device, represented by the latitude, longitude and height and the positional information of the two communication targets T1 and T2;

a means E1 for calculating the elevation angle $\phi$ of the first and second arms when they orthogonally intersect the plane P, based on the calculation result from the means D;

a means E2 for calculating the azimuth angle $\theta$ of the first and second arms when they orthogonally intersect the plane P, based on the calculation result from the means D;

a means F1 for calculating the required angle of rotation RB of axis B that is orthogonal to the axes C1 and C2 so that the elevation angle of the first and second arms will be set at $\phi$, based on the current elevation of the first and second arms, detected by the elevation detecting means and the calculation result from the means E1;

a means F2 for calculating the required angle of rotation RA of axis A that is orthogonal to the axis B as well as to the axes C1 and C2 so that the azimuth angle of the first and second arms will be set at $\theta$, based on the current azimuth of the first and second arms, detected by the azimuth detecting means and the calculation result from the means E2;

a means F3 for calculating the required angle of rotation RC1 of the axis C1 so that the first antenna is pointed at the communication target T1 when the elevation angle and azimuth angle of the first and second arms are set at $\phi$ and at $\theta$; and a means F4 for calculating the required angle of rotation RC2 of the axis C2 so that the second antenna is pointed at the communication target T2 when the elevation angle and azimuth angle of the first and second arms are set at $\phi$ and at $\theta$, the antenna control method comprising:

a step of calculating the plane P1 containing a triangle defined by the two communication targets T1 and T2 and the installed position of the antenna device, using the means D;

a step of calculating the elevation angle $\phi$1 and azimuth angle $\theta$1 of the first and second arms when they orthogonally intersect the plane P1 based on the calculation result from the means D, using the means E1 and E2;

a step of actuating the elevation adjustment mechanism and azimuth adjustment mechanism so that the direction of the first and second arms represented by the elevation angle $\phi$1 and the azimuth angle $\theta$1 will orthogonally intersect the plane P1, based on the calculation results from the means E1 and E2; and a step of actuating the first rotating mechanism and the second rotating mechanism so that the first antenna and the second antenna will be pointed toward respective communication targets T1 and T2, based on the calculation results from the means E3 and E4, whereby the first arm and the second arm and each of the antennae are moved to point the antennae toward the communication targets T1 and T2.

4. The antenna control method according to claim 3, wherein the antenna includes: a first received signal level measuring means for measuring the received signal level at the first antenna; and a second received signal level measuring means for measuring the received signal level at the second antenna, the method further comprising a step of maintaining the received signal level by starting a tracking operation when the received signal level measured by either the first received signal level measuring means or the second received signal level measuring means becomes lower than the predetermined reference value for actuating a tracking operation.

5. The antenna control method according to claim 3, wherein the antenna includes: a first received signal level measuring means for measuring the received signal level at the first antenna; and a second received signal level measuring means for measuring the received signal level at the second antenna, the method further comprising a step of maintaining the received signal level by starting a tracking operation of one of the communication targets by both the first antenna and the second antenna when the received signal level measured by either the first received signal level measuring means or the second received signal level measuring means becomes lower than the predetermined reference value for actuating a tracking operation whereby both the first antenna and the second antenna track one communication target.

6. The antenna control method according to claim 5, wherein in the case where the tracking operation of both the first antenna and the second antenna have started to track one of the communication targets, when the received signal levels measured by both the first received signal level measuring means and the second received signal level measuring means have exceeded the predetermined reference value for restarting the normal tracking operation, for a period longer than a fixed period of time, tracking of the other communication target which has been abandoned is restarted.

7. The antenna control method according to claim 3, wherein, when the number of communication targets is one, the first antenna and the second antenna are caused to acquire the single communication target at the same time so as to increase the transmitted signal level and received signal level compared to the case where the target is tracked by either the first antenna or the second antenna alone.

8. An antenna control method for controlling the antenna control system for use in a communication system made up of combination of an antenna device and communication targets, the antenna device of which the positional information being known, comprising:

first and second arms, which are arranged in parallel and in a non-opposing manner on the same plane, respectively having axes C1 and C2 along the same direction;

a first antenna which is supported by the first arm so that the attitude can be directed arbitrarily with respect to the axis C1;

a second antenna which is supported by the second arm so that the attitude can be directed arbitrarily with respect to the axis C2;

a first rotating mechanism for rotating the first antenna about axis C1;

a second rotating mechanism for rotating the second antenna about axis C2;

an arm elevation adjustment mechanism for common adjustment of the first arm and second arm; and an arm azimuth adjustment mechanism for common adjustment of the first arm and second arm, the communication targets including two communication targets T1 and T2 of which the positional information or movement information is known, the antenna control system comprising:

a first rotational angle detecting means for detecting the rotational angle of the first rotating mechanism;

a first rotating mechanism control means for controlling the first rotating mechanism;

a second rotational angle detecting means for detecting the rotational angle of the second rotating mechanism;

a second rotating mechanism control means for controlling the second rotating mechanism;

an elevation detecting means for detecting the elevation angle of the arm elevation adjustment mechanism;

an arm elevation adjustment mechanism control means for controlling the arm elevation adjustment mechanism;

an azimuth detecting means for detecting the azimuth angle of the arm azimuth adjustment mechanism;

an arm azimuth adjustment mechanism control means for controlling the arm azimuth adjustment mechanism;

a means D for calculating the plane P containing a triangle defined by two communication targets T1 and T2 and the installed position of the antenna device, based on the installed position of the antenna device, represented by the latitude, longitude and height and the positional information of the two communication targets T1 and T2;

a means E1 for calculating the elevation angle $\phi$ of the first and second arms when they orthogonally intersect the plane P, based on the calculation result from the means D;

a means E2 for calculating the azimuth angle $\theta$ of the first and second arms when they orthogonally intersect the plane P, based on the calculation result from the means D;

a means F1 for calculating the required angle of rotation RB of axis B that is orthogonal to the axes C1 and C2 so that the elevation angle of the first and second arms will be set at $\phi$, based on the current elevation of the first and second arms, detected by the elevation detecting means and the calculation result from the means E1;

a means F2 for calculating the required angle of rotation RA of axis A that is orthogonal to the axis B as well as to the axes C1 and C2 so that the azimuth angle of the first and second arms will be set at $\theta$, based on the current azimuth of the first and second arms, detected by the azimuth detecting means and the calculation result from the means E2;

a means F3 for calculating the required angle of rotation RC1 of the axis C1 so that the first antenna is pointed at the communication target T1 when the elevation angle and azimuth angle of the first and second arms are set at $\phi$ and at $\theta$; and a means F4 for calculating the required angle of rotation RC2 of the axis C2 so that the second antenna is pointed at the communication target T2 when the elevation angle and azimuth angle of the first and second arms are set at $\phi$ and at $\theta$, the antenna control method comprising: a system whereby one of the communication targets to be communicated with is switched from the communication target T2 to a communication target T3 which is located in a direction different from the communication target T2, a step of calculating the plane P2 containing a triangle defined by the communication targets T1 and T3 and the installed position of the antenna device, using the means D;

a step of calculating the elevation angle $\phi$2 and azimuth angle $\theta$2 of the first and second arms when they orthogonally intersect the plane P2 based on the calculation result from the means D, using the means E1 and E2; and a step of rotating the first antenna when the arm elevation adjustment mechanism and the arm azimuth adjustment mechanism are actuated, in a manner that the direction of the first antenna being pointed at the first communication target T1 remains as is, canceling the influence on the direction of the antenna due to change of the elevation and azimuth of the arm, whereby the communication target can be switched from the communication target T2 to the communication target T3 while communication with the communication target T1 is maintained.

* * * * *